US009068792B2

(12) United States Patent
Macy

(10) Patent No.: US 9,068,792 B2
(45) Date of Patent: Jun. 30, 2015

(54) PROJECTILE LAUNCHER ABLE TO LAUNCH AN OBJECT USING A HAMMER

(75) Inventor: Omar Alonso Macy, San Jose, CA (US)

(73) Assignee: Real Action Paintball (RAP4), Gilroy, CA (US)

( * ) Notice: Subject to any disclaimer, the term of this patent is extended or adjusted under 35 U.S.C. 154(b) by 0 days.

(21) Appl. No.: 13/598,097

(22) Filed: Aug. 29, 2012

(65) Prior Publication Data

US 2014/0060512 A1 Mar. 6, 2014

(51) Int. Cl.
*F41B 11/723* (2013.01)
*F41B 11/70* (2013.01)
*F41B 11/62* (2013.01)

(52) U.S. Cl.
CPC ..... *F41B 11/62* (2013.01); *F41B 11/723* (2013.01)

(58) Field of Classification Search
CPC ..... F41B 11/00; F41B 11/70; F41B 11/72; F41B 11/721; F41B 11/723
USPC ..... 124/56, 70, 71, 72, 73, 74, 75, 76, 77
See application file for complete search history.

(56) References Cited

U.S. PATENT DOCUMENTS

| | | | | | |
|---|---|---|---|---|---|
| 3,380,183 | A * | 4/1968 | Sullivan et al. | 42/75.02 |
| 4,422,433 | A * | 12/1983 | Milliman | 124/74 |
| 5,165,383 | A * | 11/1992 | Ebert et al. | 124/74 |
| 5,285,766 | A * | 2/1994 | Milliman | 124/72 |
| 5,477,843 | A * | 12/1995 | Kunimoto | 124/73 |
| 5,505,188 | A * | 4/1996 | Williams | 124/74 |
| 5,509,399 | A * | 4/1996 | Poor | 124/76 |
| 5,673,679 | A * | 10/1997 | Walters | 124/53.5 |
| 5,704,150 | A * | 1/1998 | Milliman | 42/67 |
| 6,158,424 | A * | 12/2000 | Kunimoto | 124/73 |
| 7,353,816 | B2 * | 4/2008 | Maeda et al. | 124/73 |
| 7,387,117 | B2 * | 6/2008 | Kunimoto | 124/73 |
| 7,836,872 | B2 * | 11/2010 | Tseng | 124/72 |
| 7,861,702 | B1 * | 1/2011 | Sze | 124/73 |
| 8,051,847 | B2 * | 11/2011 | Hu | 124/73 |
| 8,156,930 | B2 * | 4/2012 | Hu | 124/71 |
| 8,176,907 | B2 * | 5/2012 | Wei | 124/53 |
| 8,464,454 | B2 * | 6/2013 | Martin et al. | 42/69.01 |
| 8,567,379 | B2 * | 10/2013 | Hu | 124/60 |
| 2004/0200466 | A1 * | 10/2004 | Salva | 124/74 |
| 2005/0011508 | A1 * | 1/2005 | Kunimoto | 124/73 |
| 2007/0028911 | A1 * | 2/2007 | Chen | 124/74 |
| 2007/0181116 | A1 * | 8/2007 | Wei | 124/74 |
| 2010/0071680 | A1 * | 3/2010 | Tseng | 124/80 |
| 2010/0229843 | A1 * | 9/2010 | Hu | 124/80 |
| 2010/0263652 | A1 * | 10/2010 | Maeda et al. | 124/73 |
| 2011/0017188 | A1 * | 1/2011 | Call | 124/73 |
| 2011/0041825 | A1 * | 2/2011 | Hu | 124/71 |
| 2011/0146647 | A1 * | 6/2011 | Hu | 124/76 |
| 2012/0048253 | A1 * | 3/2012 | Hu | 124/73 |
| 2013/0047481 | A1 * | 2/2013 | Macy et al. | 42/49.01 |
| 2013/0269671 | A1 * | 10/2013 | Tseng | 124/74 |
| 2013/0291848 | A1 * | 11/2013 | Wood | 124/73 |

* cited by examiner

*Primary Examiner* — Bret Hayes
*Assistant Examiner* — Derrick Morgan
(74) *Attorney, Agent, or Firm* — James M. Wu; JW Law Group

(57) ABSTRACT

A projectile launching device such as a paintball gun capable of firing a paintball using a hammer is disclosed. The paintball gun, in one embodiment, includes a bolt, a valve, and a hammer wherein the bolt has an air channel and is able to move within a bolt chamber. The valve, which is situated in a firing control chamber arranged in parallel to the bolt chamber, controls pressurized gas. The hammer, in one aspect, includes a pivot hole capable of hosting a pivot pin which facilitates a swing motion for the hammer. When the hammer swings around the pivot hole, the hammer contacts the valve whereby a portion of the pressurized gas is release. The bolt further includes a hammer reset element which is able to reset the hammer to a ready for firing position during a launch process.

19 Claims, 27 Drawing Sheets

PROJECTILE LAUNCHER ABLE TO LAUNCH AN OBJECT USING A HAMMER

CROSS-REFERENCE TO RELATED APPLICATIONS

This application is related to the following co-pending applications assigned to the Assignee of the present invention:

a. Application Ser. No. 13,598,016, filed Aug. 29, 2012, entitled "PROJECTILE LAUNCHER HAVING UPPER RECEIVER PIVOTALLY COUPLED TO LOWER RECEIVER," invented by Macy.

b. Application Ser. No. 13/598,050, filed Aug. 29, 2012, entitled "PAINTBALL LAUNCHER EMPLOYING A CARRIER FOR STRIKER RESET BEFORE DISCONNECTING FROM STRIKER," invented by Macy.

FIELD

The present invention relates to projectile propelling systems or apparatus. More specifically, the present invention relates to structure of a projectile launcher having a structure arrangement consistent with conventional lethal firearms.

BACKGROUND

Paintball guns and/or markers have become quite popular in recent years for various practical applications. For example, paintball guns can be used in professional trainings, such as trainings for soldiers, policemen, security personals, and/or athletic participants. The success of training and/or competition may largely depend on how closely the paintball guns mimic and/or resemble the real firearms or semi-automatic hand guns.

A drawback for using a conventional paintball gun or marker in place of a real gun is that the physical structure and appearance of a typical paintball marker are different from real firearms and/or guns. Since a conventional structure of a paintball marker is different from the firearms and/or guns, operations as well as maintenance of a paintball marker can also be different from real firearms, guns, and/or rifles. For example, during an exercise, restoring a jammed paintball gun involves different operational procedures than the process of recovering a jammed firearm(s).

SUMMARY

A projectile launching device such as a paintball gun capable of firing a paintball using a hammer is disclosed. The paintball gun, in one embodiment, includes a bolt, a valve, and a hammer wherein the bolt has an air channel and is able to move within a bolt chamber. The valve, which is situated in a firing control chamber arranged in parallel to the bolt chamber, controls pressurized gas. The hammer, in one aspect, includes a pivot hole capable of hosting a pivot pin which facilitates a swing motion for the hammer. When the hammer swings around the pivot hole, the hammer contacts the valve whereby a portion of the pressurized gas is release. The bolt further includes a hammer reset element which is able to reset the hammer to a ready for firing position during a launch process.

Additional features and benefits of the exemplary embodiment(s) of the present invention will become apparent from the detailed description, figures and claims set forth below.

BRIEF DESCRIPTION OF THE DRAWINGS

Exemplary embodiment(s) of the present invention will be understood more fully from the detailed description given below and from the accompanying drawings of various embodiments of the invention, which, however, should not be taken to limit the invention to the specific embodiments, but are for explanation and understanding only.

DETAILED DESCRIPTION

Figure 1A:
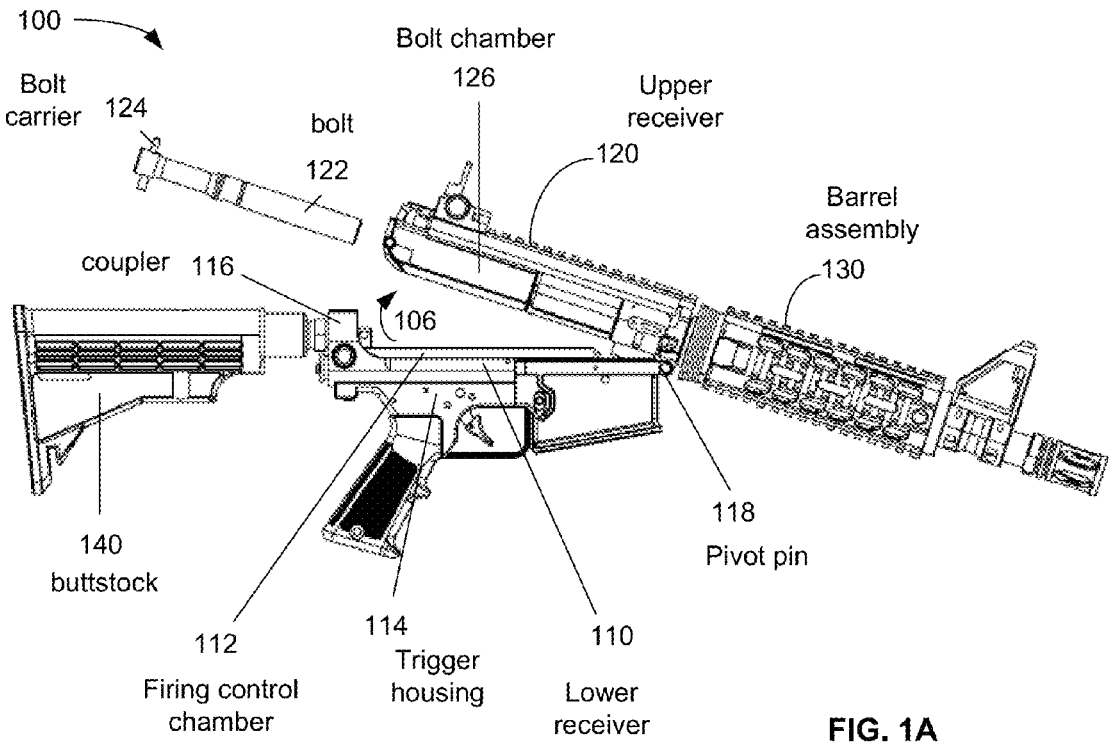
FIGS. 1A-B illustrate diagrams showing an exemplary projectile launcher having an upper receiver and a lower receiver wherein the upper receiver is able to pivotally swing away from a lower receiver in accordance with one embodiment of the present invention.

Exemplary embodiment(s) of the present invention is described herein in the context of a method, system and apparatus of providing a paintball launcher having an upper receiver able to be pivotally swung away from a lower receiver.

Those of ordinary skills in the art will realize that the following detailed description of the exemplary embodiment(s) is illustrative only and is not intended to be in any way limiting. Other embodiments will readily suggest themselves to such skilled persons having the benefit of this disclosure. Reference will now be made in detail to implementations of the exemplary embodiment(s) as illustrated in the accompanying drawings. The same reference indicators will be used throughout the drawings and the following detailed description to refer to the same or like parts.

References to "one embodiment," "an embodiment," "example embodiment," "various embodiments," "exemplary embodiment," "one aspect," "an aspect," "exemplary aspect," "various aspects," etc., indicate that the embodiment(s) of the invention so described may include a particular feature, structure, or characteristic, but not every embodiment necessarily includes the particular feature, structure, or characteristic. Further, repeated use of the phrase "in one embodiment" does not necessarily refer to the same embodiment, although it may.

In the interest of clarity, not all of the routine features of the implementations described herein are shown and described. It will, of course, be understood that in the development of any such actual implementation, numerous implementation-specific decisions may be made in order to achieve the developer's specific goals, such as compliance with application- and business-related constraints, and that these specific goals will vary from one implementation to another and from one developer to another. Moreover, it will be understood that such a development effort might be complex and time-consuming, but would nevertheless be a routine undertaking of engineering for those of ordinary skills in the art having the benefit of this disclosure.

Various embodiments of the present invention illustrated in the drawings may not be drawn to scale. Rather, the dimensions of the various features may be expanded or reduced for clarity. In addition, some of the drawings may be simplified for clarity. Thus, the drawings may not depict all of the components of a given apparatus (e.g., device) or method.

As used herein, the singular forms of article "a", "an" and "the" are intended to include the plural forms as well, unless the context clearly indicates otherwise. Also, the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. The term "and/or" includes any and all combinations of one or more of the associated listed items.

One embodiment of the presently disclosed invention illustrates a projectile launcher having an upper receiver and a lower receiver. The upper receiver is able to be swung away from a lower receiver. The lower receiver of paintball launcher, in one example, having a first end and a second end contains a firing control chamber. While the second end is configured to be located closer or adjacent to the barrel of the launcher, the first end of launcher is located closer to the buttstock of the launcher. The firing control chamber includes a first gas channel wherein one end of the first gas channel is coupled to a valve for gas controlling and the second end of the first gas channel reaches to the top of external wall of the firing control chamber.

The upper receiver, on the other hand, also having a first end and second end includes a bolt chamber containing a second gas channel. The second end of upper receiver and the second end of lower receiver are pivotally coupled whereby allowing the first end of upper receiver to be pivotally swung away from the first end of lower receiver. The first end of second gas channel is configured to reach inside of the bolt chamber for gas delivery while the second end of second gas channel is configured to reach to the bottom of external wall of the bolt chamber. When the upper receiver and the lower receiver are in closed position, the second end of second gas channel and the second end of the first gas channel are connected for gas delivery.

Figure 1B:
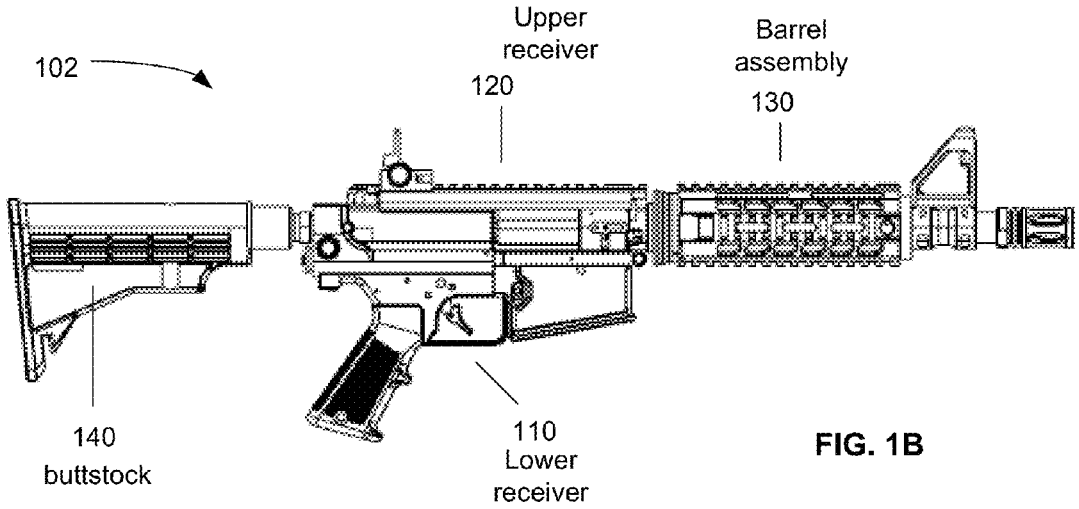

FIGS. 1A-B illustrate diagrams 100-102 showing an exemplary projectile launcher having an upper receiver and a lower receiver wherein the upper receiver is able to pivotally swing away from a lower receiver in accordance with one embodiment of the present invention. Diagram 100 illustrates a projectile launcher in an open position and diagram 102 illustrates a projectile launcher in a closed position. It should be noted that the projectile launcher can be non-lethal, less-lethal, or lethal firearm(s). It should be noted that the underlying concept of the exemplary embodiment(s) of the present invention would not change if one or more components (or units) were added to or removed from diagram 100 or 102.

The launcher, in one aspect, includes an upper receiver 120, a lower receiver 110, a barrel assembly 130, and a buttstock 140. Upper receiver 120, which is also known as upper paintball marker or top paintball assembly, includes a bolt chamber 126 configured to house a bolt 122. Upper receiver 120 is structured with a first end and a second end wherein the first end is used for coupling to barrel assembly 130 and the second end couples to a coupler 116 or buttstock 140. In one embodiment, the first end of upper receiver 120 includes a pivot hole used to couple to lower receiver 110 using a pivot pin 118.

Bolt 122, in one aspect, is situated inside of bolt chamber 126 and can slide out of bolt chamber 126 when the paintball marker requires maintenance or cleaning. A function of bolt 122 is to push a paintball into a firing chamber and then channels a stream of compressed or pressurized gas or air to launch an object such as paintball. An object can also be referred to as any projectile, such as, but not limited to, paintball, non-lethal projectile, a less-lethal projectile, and/or lethal projectile. For example, non-lethal projectile can be a food-color based paintball, and lethal projectile can be a bullet. It should be noted that the terms "paintball," "non-lethal projectile," "less-lethal projectile," and "lethal projectile" will be used interchangeably herein.

In one embodiment, bolt 122 includes a bolt carrier 124 which is configured to extend into lower receiver 110 and releasably attach to a striker. For example, when the paintball marker is in the open position, bolt carrier 124 disconnects from the striker. When, however, the paintball returns to the closed position as shown in diagram 102, bolt carrier 124 reconnects to the striker in lower receiver 110.

Lower receiver 110, which is also known as lower paintball marker or bottom paintball assembly, includes a firing control chamber 112 configured to house a striker. In one example, lower receiver 110 is structured with a first end and a second end wherein the first end is used for coupling to barrel assembly 130 and the second end is used for coupling to buttstock 140. In one embodiment, the first end of lower receiver 110 includes a pivot hole configured to couple to the first end of upper receiver 120 using pivot pin 118. In one embodiment, lower receiver 110 further includes a trigger housing 114 providing a triggering mechanism for a user.

During an operation, a user can pull, slide, or disassembly a take-down pin, not shown in FIGS. 1A-B, to disconnect one end of upper receiver 120 from lower receiver 110 as the paintball marker is in a closed position as shown in diagram 102. Upon removing the take-down pin from coupler 116, upper receiver 120 can be swung open in a direction indicated by arrow 106. Once the paintball maker is in an open position as shown in diagram 100, the user can pull bolt 122 from upper receiver 120 for cleaning and/or regular maintenance. After inserting bolt 122 back into bolt chamber 126, the paintball marker is ready to be function after upper receiver 120 is reattached to lower receiver 110 via the take-down pin. It should be noted that during the motion of transforming a paintball marker from an open position to a closed position, bolt carrier 124 is so designed that a portion of bolt carrier 124 moves through at least a portion of lower receiver 110 before it can catch the striker in the firing control chamber.

An advantage of allowing upper receiver 120 to be able to separate from lower receiver 110 is that such structure is more closely resemblance of real firearm and/or rifles whereby it provides more realistic simulation and/or training of handling lethal firearm.

Figure 2:
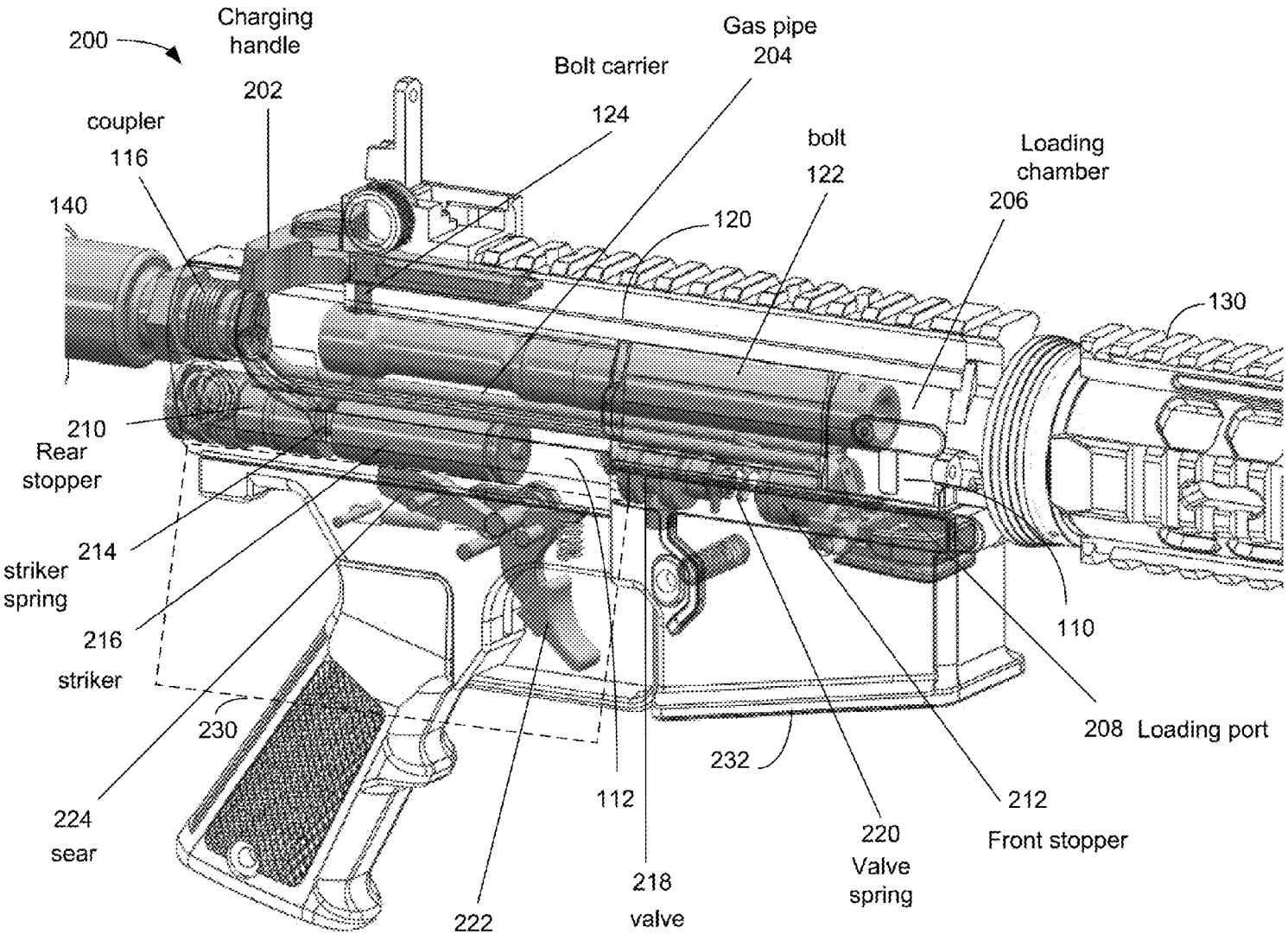
FIG. 2 is a three-dimensional ("3D") diagram illustrating a paintball launcher having an upper receiver and a lower receiver in a closed position in accordance with one embodiment of the present invention.

FIG. 2 is a three-dimensional ("3D") diagram illustrating a paintball launcher 200 having an upper receiver and a lower receiver in a closed configuration in accordance with one embodiment of the present invention. Launcher 200 includes upper receiver 120, lower receiver 110, buttstock 140, and barrel assembly 130. Lower receiver 110 further includes a triggering mechanism including trigger 222 and sear 224 for firing control. It should be noted that the underlying concept of the exemplary embodiment(s) of the present invention would not change if one or more components (or units) were added to or removed from launcher 200.

Upper receiver 120, in one embodiment, includes bolt chamber 126, bolt 122, and charging handle 202. Bolt chamber 126 including a loading chamber 206 is configured to control the movement of bolt 122 for launching paintballs. A portion or top end of bolt carrier 124 is used to couple to charging handle 202 and a mid-portion of bolt carrier 124 is used to anchor or fasten to bolt 122. Another portion or bottom end of bolt carrier 124 is configured to be removably attachable to striker 216. In one example, bottom end of bolt carrier 124 extends from upper receiver 120 into lower receiver 110 before it latches or attaches to striker 216.

Charging handle 202, which can also be referred to as cocking handle, is situated on top part of upper receiver 120 and is used to cock a striker such as striker 216 to a ready to fire position. In an open position, charging handle 202 may be used to pull bolt 122 out of bolt chamber for various operations such as cleaning jam and replacing parts. It should be noted that charging handle 202 can be located anywhere in the vicinity of bolt 122 without altering the underlying concept of present invention.

Firing control chamber 112, in one embodiment, further includes rear stopper 210, striker spring 214, striker 216, valve 218, valve spring 220 and front stopper 212 wherein rear stopper 210 is located at the second end of lower receiver 110 while front stopper 212 is located at the first end of lower receiver 110. Firing control chamber 112 is configured to efficiently control the movement of striker 216 between cocked position and striking position. Note that cocked position is ready to firing position while striking position is firing position that pushes valve open. Coupler 116 is situated at the second end of lower receiver 110 and is used for coupling upper receiver 120 to lower receiver 110. In one example, coupler 116 is also used to couple to buttstock 140.

Triggering mechanism 230 includes trigger 222 and sear 224 allowing a user to pull or squeeze trigger 222 for launching a paintball. Sear 224 is used to set or keep striker 216 in a cocked or reset position which is a ready to fire position. Magazine receiver port 232, in one example, is used to receiver a magazine, not shown in FIG. 2, containing multiple paintballs.

Lower receiver 110 further includes a gas pipe 204 which is a built-in channel within the structure of lower receiver 110. A function of gas pipe 204 is to transfer pressurized or compressed gas from a gas tank to the vicinity of valve 218. The gas tank, not shown in FIG. 2, may reside in buttstock 140 or bottom of pistol grip. It should be noted that gas pipe 204 could also be configured in upper receiver 120 depending on the applications.

Launcher 200, in one example, is configured to include a shoulder stock or buttstock 140 capable of containing a gas source(s). The gas source may be a nitrogen tank, a carbon dioxide (CO2) canister, and/or a compressed air canister. In an alternative example, launcher 200 may include a gas source which is mounted beneath the assembly.

Figure 3:
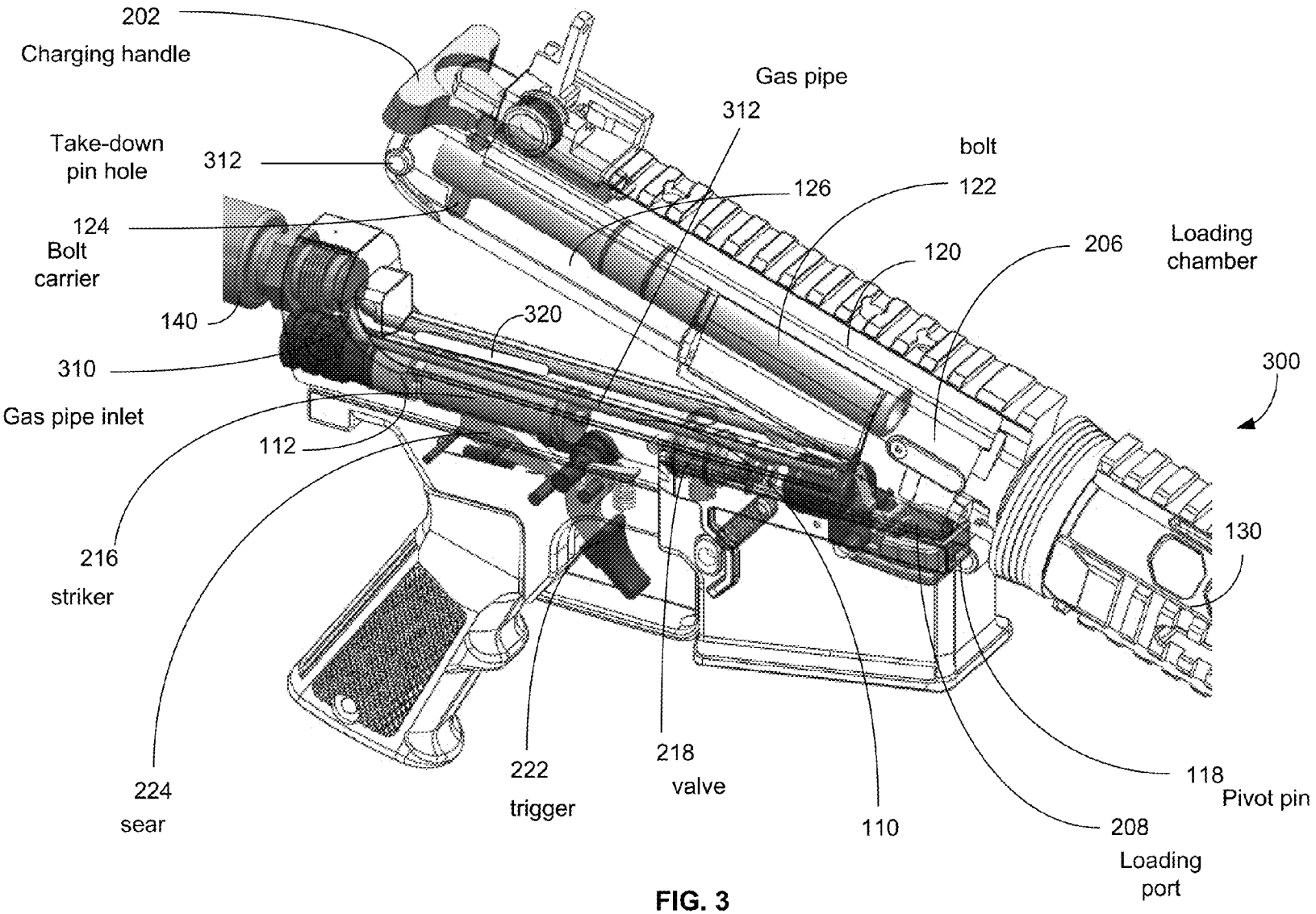
FIG. 3 is a 3D diagram illustrating a paintball launcher having an upper receiver and a lower receiver in an open position in accordance with one embodiment of the present invention.

FIG. 3 is a 3D diagram illustrating a projectile launcher 300 having an upper receiver and a lower receiver in an open position in accordance with one embodiment of the present invention. Launcher 300, which is the same or similar launcher 200 shown in FIG. 2, includes upper receiver 120, lower receiver 110, buttstock 140, and barrel assembly 130. Lower receiver 110 further includes a triggering mechanism including trigger 222 and sear 224 for firing control. It should be noted that the underlying concept of the exemplary embodiment(s) of the present invention would not change if one or more components (or units) were added to or removed from launcher 300.

Lower receiver 110, in one embodiment, has a first end and a second end wherein the first end is adjacent to buttstock 140 and the second end is adjacent to barrel 130 of launcher 300. Lower receiver 110 contains a firing control chamber 112 which includes a first gas channel. The first end of the first gas channel is coupled to a valve situated in the firing control chamber 112 and the second end of the first gas channel reaches to the top external wall of firing control chamber 112. Gas pipe 204 is embedded in lower receiver 110 and is used to guide a stream of pressurized gas from a gas tank via gas pipe inlet 310 to bolt chamber 126.

Upper receiver 120 includes a second channel, not shown in FIG. 3. The second end of first gas channel on lower receiver 110 and the second end of second gas channel on upper receiver 120 are configured to make an airtight or substantially airtight coupling. For example, when upper receiver 120 and lower receiver 110 are in the closed position, the first gas channel on lower receiver 110 and the second gas channel on upper receiver 120 are capable of make airtight coupling. The airtight coupling means the channel coupling connection is hermitically sealed. The first end of second gas channel reaches to inside of bolt chamber 126 for gas delivery while the second end of second gas channel reaches to the bottom external wall of bolt chamber 126 for coupling to the second end of first gas channel.

Upper receiver 120 is structured with a first end and a second end. The first end is located adjacent to buttstock 140 and a second end is situated adjacent to barrel 130. The second end of upper receiver 120 and the second end of lower receiver 110 are pivotally coupled via pivot pin 118 whereby the first end of upper receiver 120 can be pivotally swung away from the first end of lower receiver 110.

A portion of bolt carrier 124 is configured to penetrate top external wall of lower receiver via a bolt groove 320 to reach striker 216. Bolt carrier 124 has a first end and a second end wherein the first end is used to anchor bolt carrier 124 to bolt 122 and the second end is used to be releasably attached to striker 216. Note that bolt carrier 124 and striker 216 are configured in such a way that bolt carrier 124 is able to detach from striker 216 when upper receiver 120 pivotally moves away from lower receiver 110. When, however, upper receiver 120 pivotally moves toward to lower receiver 110, the second end of bolt carrier 124 passes through bolt groove 320 and attaches or catches striker 216.

Figure 4:
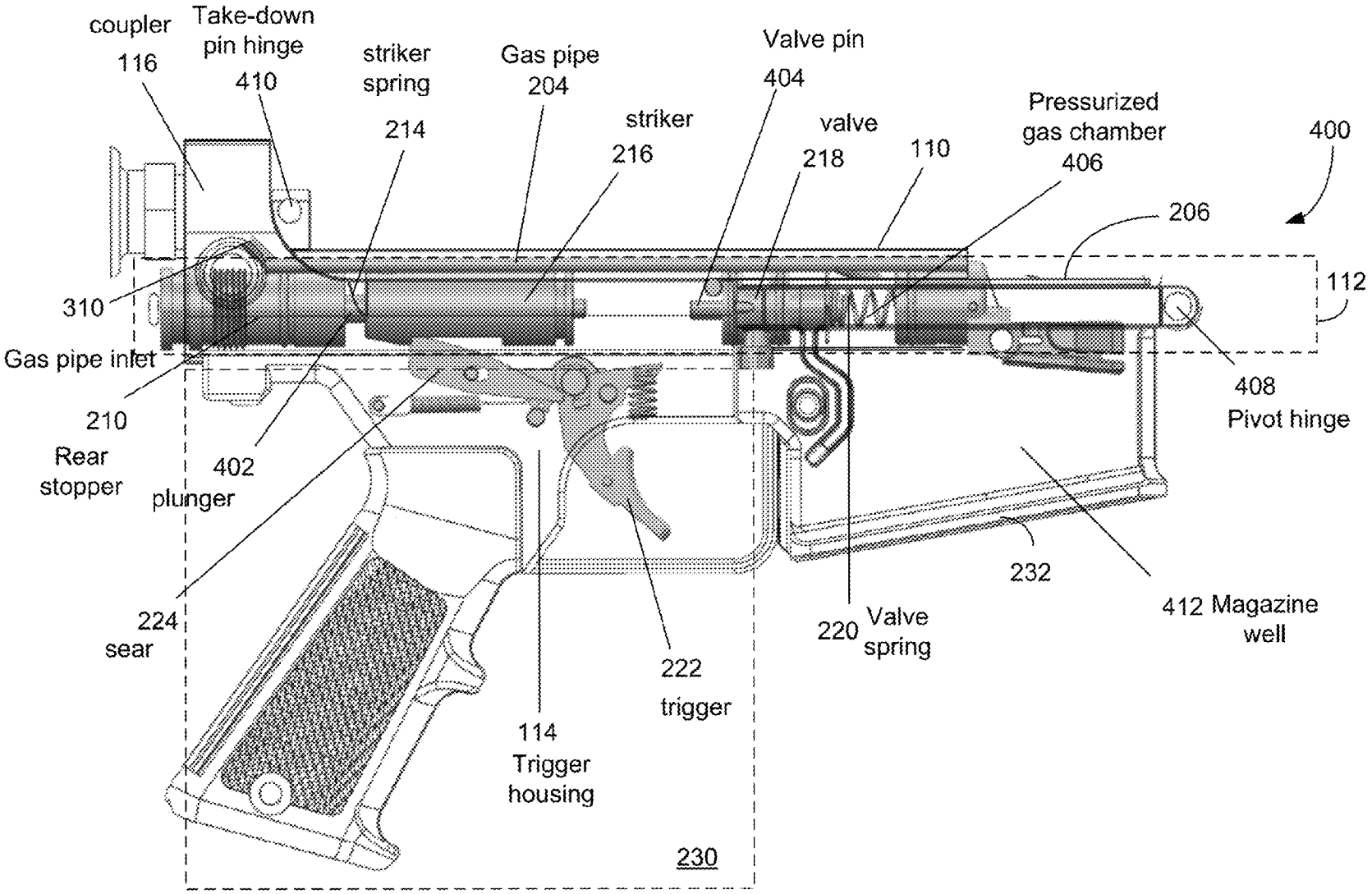
FIG. 4 is a diagram illustrating an exemplary internal structure of a lower receiver having a firing control chamber in accordance with one embodiment of the present invention.

FIG. 4 is a diagram 400 illustrating an exemplary internal structure of a lower receiver having a firing control chamber in accordance with one embodiment of the present invention. Diagram 400 includes lower receiver 110, triggering mechanism 230, and magazine receiver port 232. Lower receiver 110 includes coupler 116, take-down pin hinge 410, pivot hinge 408, and firing control chamber 112. Firing control chamber 112, in one aspect, includes striker 216, plunger 402, valve 218 with a valve pin 404, pressurized gas chamber 406, and loading chamber 206. Striker 216 as illustrated in FIG. 4 is in a cocking position ready to be fired. When trigger 222 is pulled or squeezed which causes sear 224 to release striker 216, striker 216 engages valve pin 404 to turn on valve 218 temporary in order to launch a projectile.

Take-down pin hinge 410 and pivot hinge 408 are used to facilitate opening the paintball marker to perform tasks such as cleaning and maintenance. The structural design of take-down pin hinge 410 and pivot hinge 408 is illustrative and they can be configured with different dimensions and/or locations as long as they facilitate opening the launcher between the top half receiver and the bottom half receiver. It should be noted that lower receiver 110 may be designed so that it is able to couple to one of multiple different types of upper receivers as long as a set of minimal coupling specifications is met.

Figure 5:
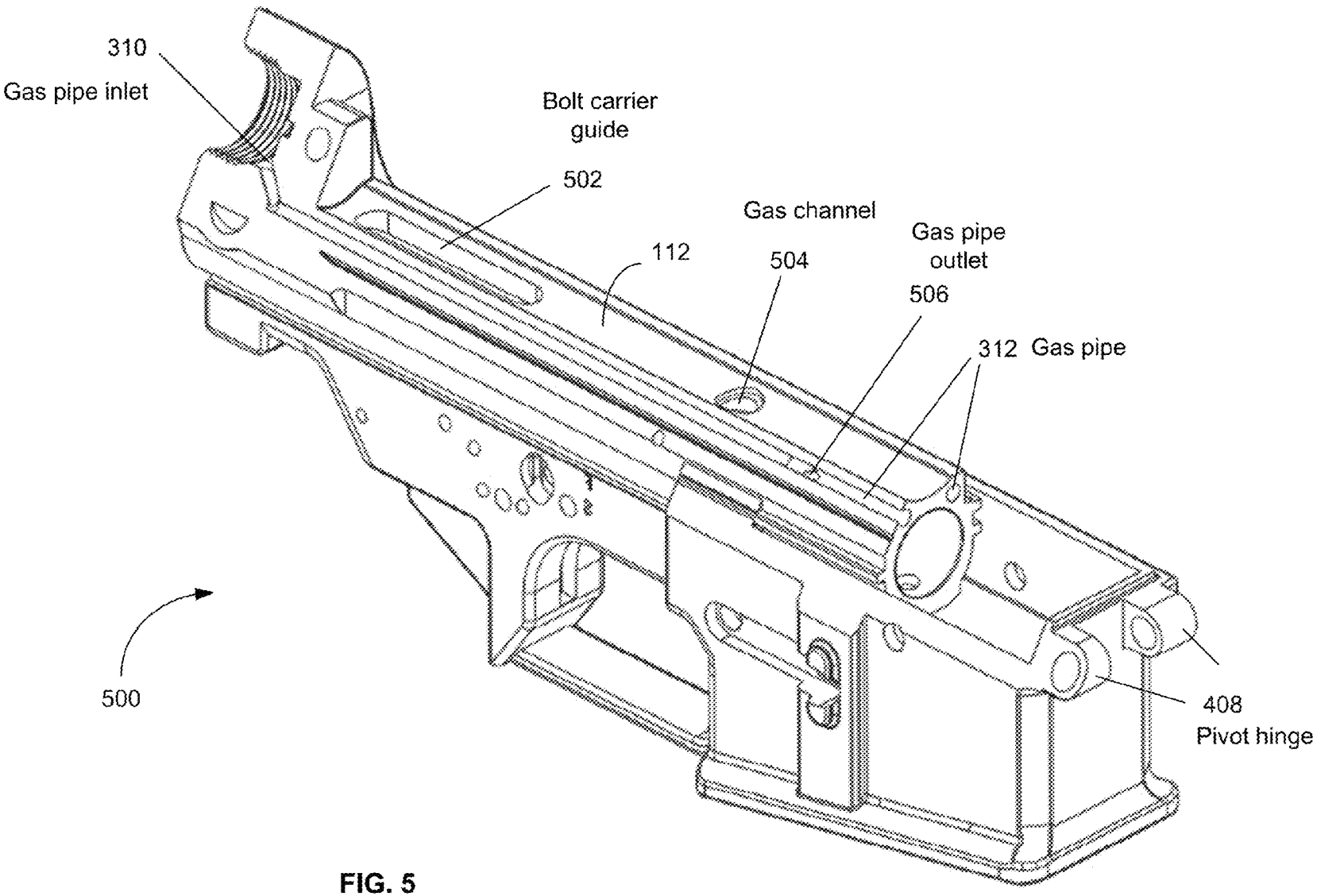
FIG. 5 is a perspective diagram illustrating a lower receiver having a firing control chamber with a built-in gas pipe in accordance with one embodiment of the present invention.

FIG. 5 is a perspective diagram illustrating a lower receiver 500 having a firing control chamber 112 with a built-in gas pipe 312 in accordance with one embodiment of the present invention. In one embodiment, firing control chamber 112 further includes a bolt carrier guide or bolt groove 502, a gas channel 504, and a gas pipe outlet 506. Bolt carrier guide or bolt groove 502, hereinafter referred to as bolt groove, is a predefined opening on the top of lower receiver 500 for guiding the movement of bolt carrier with respect to a striker situated inside of firing control chamber 112. Depending on the applications, the size or dimension of bolt groove 502 can vary to accommodate the size of bolt carrier as well as the striker. Gas pipe outlet 506 is used to channel compressed or pressurized gas from pipe inlet 310 to pressurized gas chamber via gas pipe 312. It should be noted that more or less gas pipe 312 can be added to or removed from lower receiver 500 depending on the applications. When the valve opens, pressurized gas moves from the pressurized gas chamber to the bolt chamber via gas channel 504.

Figure 6:
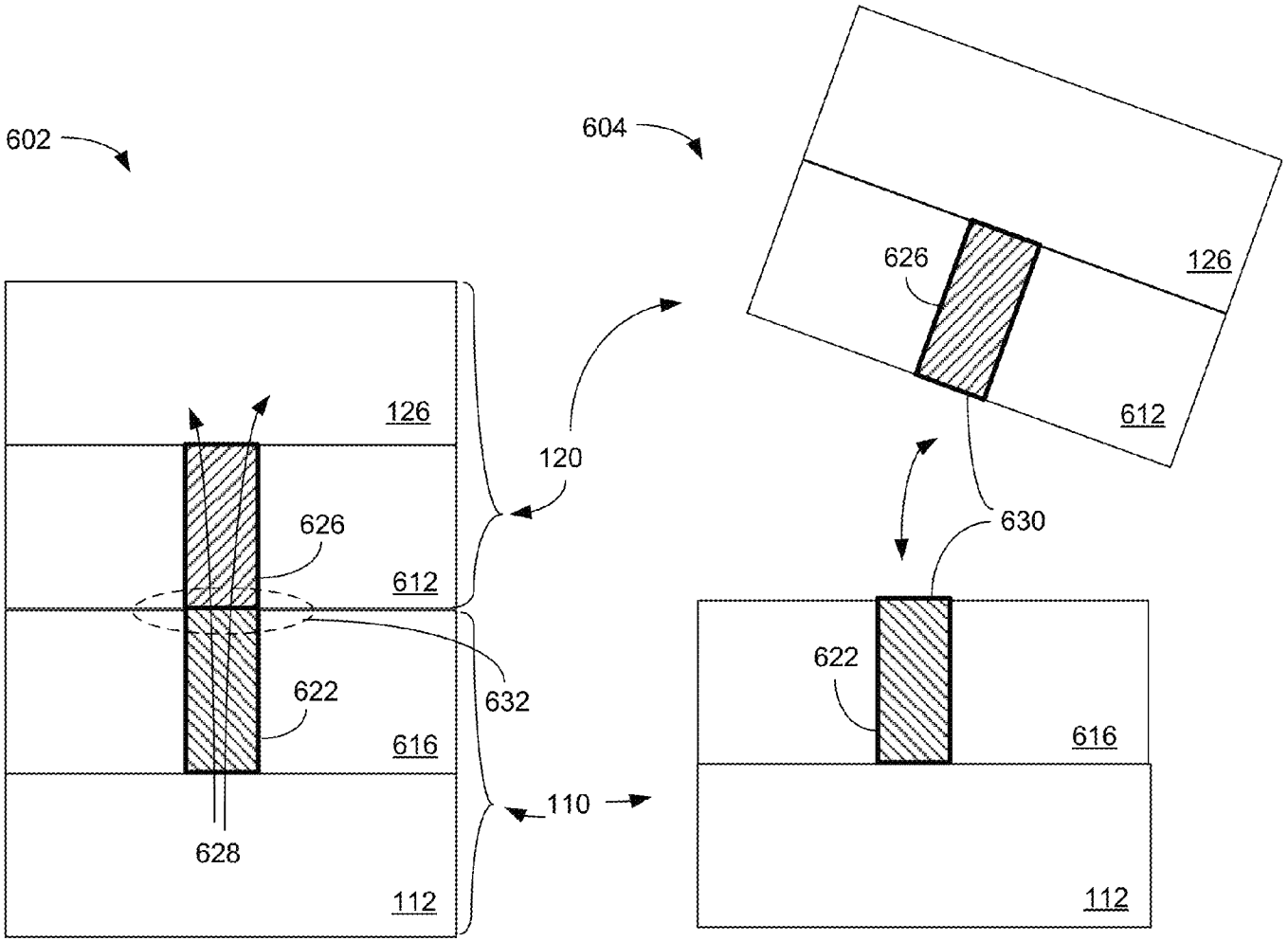
FIG. 6 is two block diagrams illustrating upper and lower gas channels in a projectile launcher in accordance with one embodiment of the present invention.

FIG. 6 shows two block diagrams 602-604 illustrating upper and lower gas channels 622-626 in a projectile launcher such as a paintball marker in accordance with one embodiment of the present invention. Diagram 602 illustrates upper receiver 120 having an upper gas channel 626 and lower receiver 110 including a lower gas channel 622. When the paintball marker, for example, is in a closed position as shown in diagram 602, upper gas channel 626 and lower gas channel 622 are connected with hermitically sealed as indicated by numeral 532 for preventing air or gas escaping between the connection.

For example, when upper receiver 120 and lower receiver 110 are in closed position, an airtight coupling between upper gas channel 626 and lower gas channel 622 is created thereby leaking of pressurized gas 628 is prevented from the coupling between upper gas channel 626 and lower gas channel 622. When gas channels 622-626 are coupled, pressurized gas 628 is able to travel from firing control chamber 112 to bolt chamber 126 via top external wall 616 of firing control chamber 112 and bottom external wall 612 of bolt chamber 126.

Diagram 604 illustrates that the paintball marker is in open position wherein upper receiver 120 and lower receiver 110 are separated from each other. When upper receiver 120 is separated from lower receiver 110, upper gas channel 626 is also separated or disconnected from lower gas channel 622 as shown by the arrow. It should be noted that surfaces 630 of upper gas channel 626 and lower gas channel 622 are configured in such a way that a hermitically sealed coupling between gas channels 622-626 via surface 630 is created when upper receiver 120 and lower receiver 110 are coupled together or in a closed position.

Figure 7:
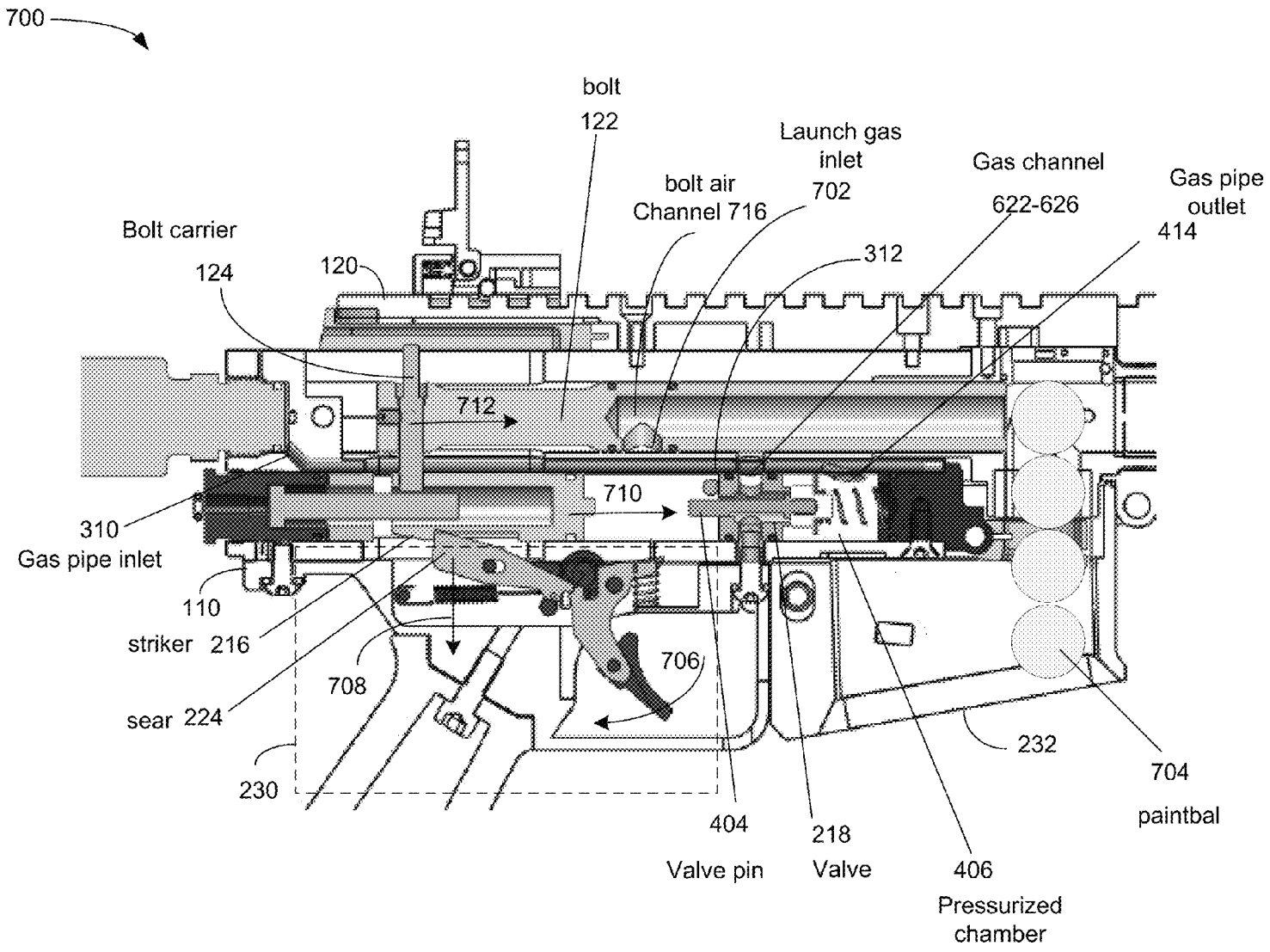
FIG. 7 is a diagram illustrating an open-bolt position before launching a projectile in accordance with one embodiment of the present invention.

FIG. 7 is a diagram 700 illustrating an open-bolt position before launching a projectile such as a paintball in accordance with one embodiment of the present invention. Diagram 700 illustrates a mechanical layout of a paintball launcher having upper receiver 120, lower receiver 110, triggering mechanism 230, and magazine receiver port 232. Magazine receiver port 232 is configured to receiver projectiles such as paintballs 704 from a magazine, not shown in the diagram, for preparing and launching. It should be noted that the underlying concept of the exemplary embodiment(s) of the present invention would not change if one or more components (or units) were added to or removed from diagram 700.

Lower receiver 110, in one aspect, includes a firing control channel containing striker 216 and valve 218, first gas channel 622 for gas delivery. Lower receiver 110 is also coupled to trigger housing or a triggering mechanism 230. Note that trigger housing 230 can be fabricated as part of lower receiver 110. Trigger housing, in one example, is coupled to the bottom side of the firing control channel and contains a trigger mechanism 230 such as trigger and sear 224. The trigger can be pulled or squeezed in a direction indicated by numeral 706. When the trigger is squeezed, it causes sear 224 to release striker 216. Lower receiver 110 further embeds a gas pipe 312 configured to connect to a pressurized gas supply source. Gas pipe 312, in one aspect, is embedded in the firing control channel.

Upper receiver 120 is pivotally coupled to lower receiver 110 and includes a second gas channel 626 configured to deliver gas from first gas channel 622 to a firing chamber. First and second gas channels 622-626 are separable when upper receiver 120 pivotally moves away from lower receiver 110. Upper receiver 120 contains a bolt carrier and a bolt wherein the bolt is coupled to the bolt carrier which releasably attaches striker 216 when upper carrier 120 is assembled to lower carrier 110.

Lower receiver 110 and upper receiver 120, in one embodiment, are separable as well as coupling via a coupler and take-down pin(s). The coupler further includes a gas pipe inlet which couples to gas pipe 312 capable of channeling compressed gas to the pressurized chamber in the firing control channel. In one aspect, the buttstock of paintball launcher includes a pressurized gas tank or supply. Striker 216, in one example, is coupled to a rear stopper with a striker spring. Valve 218 further includes a launch gas release or pin 404 configured to control releasing of pressurized gas for launching an object or paintball.

Bolt carrier 124, in one aspect, moves in synchronization with striker 216 as indicated by numeral 710 when the projectile launcher is in operation. Bolt 122 includes a launch gas inlet 702 configured to receive a stream of pressurized gas from the firing control channel via gas channels 622-626 when valve 218 is open. It should be noted that bolt 122 is in an open-bolt position because the paintball next to bolt 122 is in the loading chamber. An open-bolt position means that the paintball to be launched is located in the loading chamber. Also, an open-bolt launching means that the paintball to be launched will not be pushed into the firing chamber by the bolt before striker is released.

Figure 8:
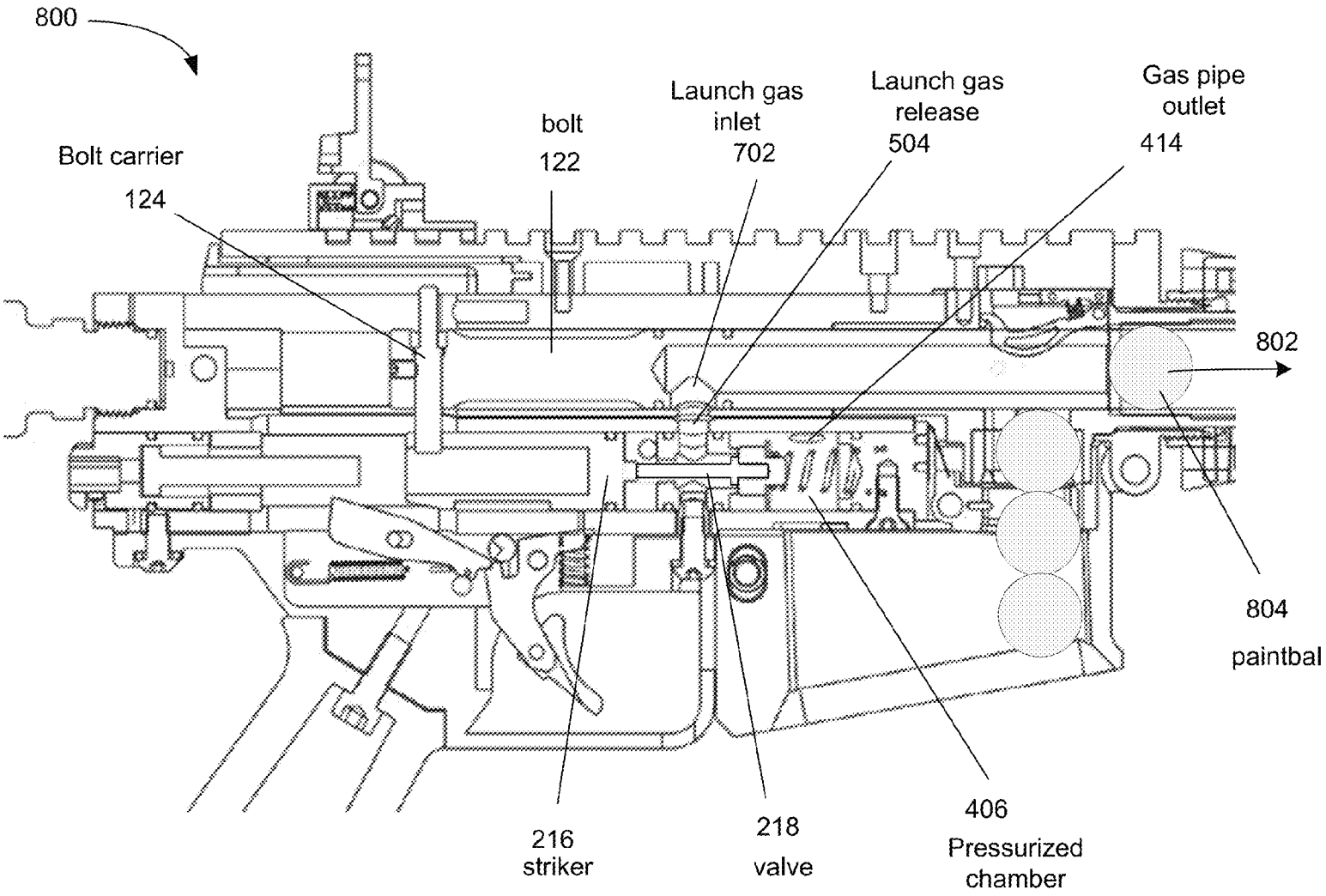
FIG. 8 is a diagram illustrating a process of launching an object in accordance with one embodiment of the present invention.

FIG. 8 is a diagram 800 illustrating a process of launching an object or paintball in accordance with one embodiment of the present invention. Diagram 800, which contain similar elements as diagram 700, illustrates that bolt 122 is in closed bolt position which means that paintball 804 is in the firing chamber when striker 216 is released. When striker 216 hits valve 218 that opens the gas gate, gas channels 622-626 are aligned with launch gas inlet 702 whereby paintball 804 is launched in a direction indicated by numeral 802 by pressurized gas from pressurized chamber 406 via gas channels 622-626 and gas inlet 702.

Figure 9:
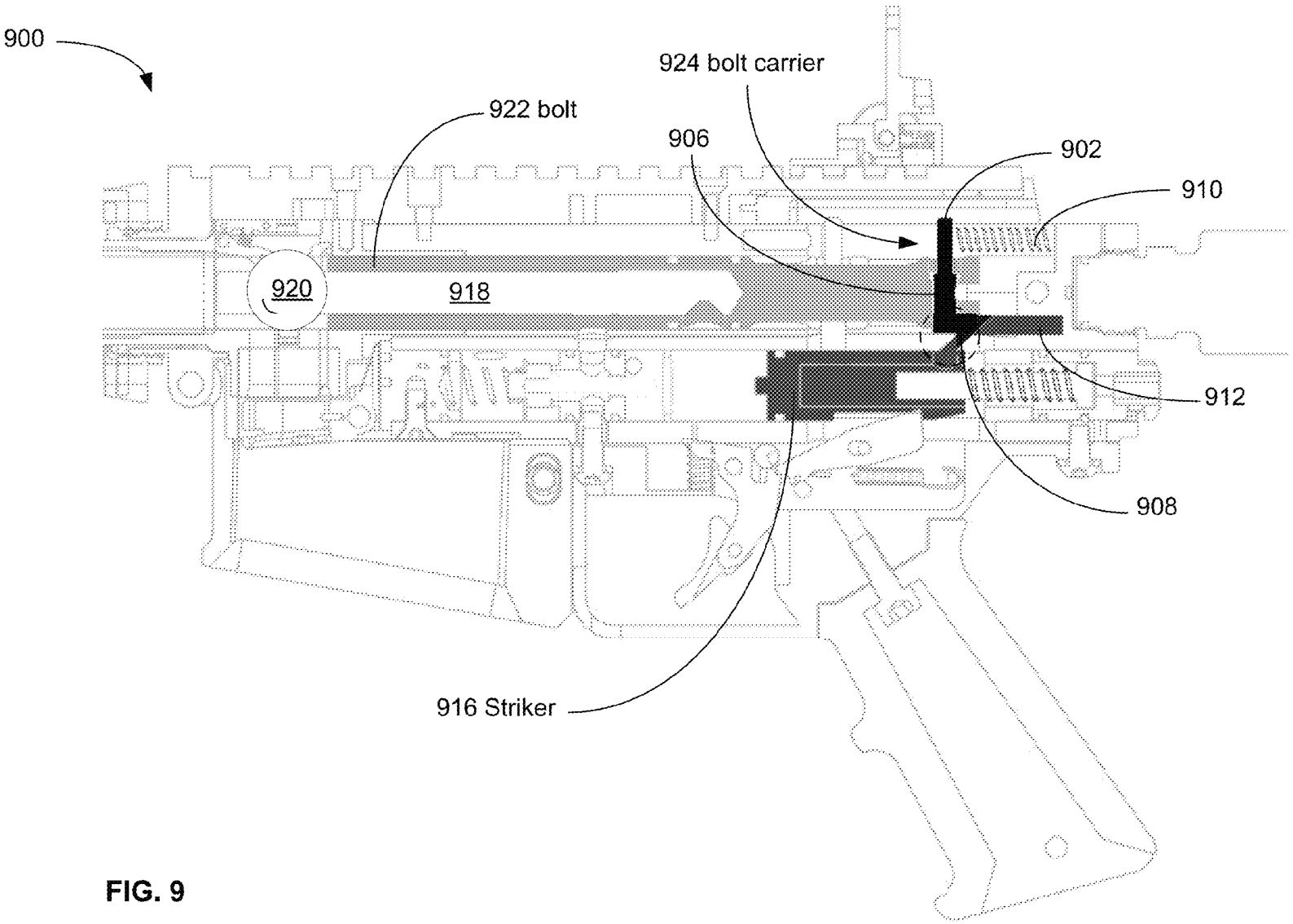
FIG. 9 illustrates a projectile launcher having a disconnectable bolt carrier capable of placing bolt in a closed-bolt position in accordance with one embodiment of the present invention.

FIG. 9 illustrates a projectile launcher 900 having a disconnectable bolt carrier ("DBC") 924 capable of placing bolt 922 in a closed bolt position in accordance with one embodiment of the present invention. Launcher 900 includes bolt 922, striker 916, a bolt reset element 910, ramp 912, and DBC 924 wherein DBC is structured or arranged to have bolt repositioning latch 902, fastener 906, and flexible latch or linkage 908. Projectile launcher 900 can be a paintball marker, paintball gun, object launcher, and the like. It should be noted that the underlying concept of the exemplary embodiment(s) of the present invention would not change if one or more components (or units) were added to or removed from launcher 900.

Bolt 922, in one aspect, includes an air channel 918 and is able to move within a bolt chamber. Air channel 918, in one example, guides and/or directs a stream of pressured air or gas to launch an object such as a paintball 920. Striker 916, in one example, includes a striker reset hook and is able to move in a direction parallel to the movement of bolt 922. The firing control chamber is physically structured in parallel to the bolt chamber whereby both bolt 922 and striker 916 can move in sync via DBC 924. As illustrated in FIG. 9, the firing control chamber is located in the lower receiver and the bolt chamber is located in the upper receiver.

DBC 924, in one aspect, uses fastener 906 to anchor or fasten DBC 924 to bolt 922. Flexible latch or linkage 908 is employed to latch DBC 924 to via striker reset hook of striker 916 for resetting striker 916 through a process of launching a projectile 920. Flexible latch 908, in one embodiment, is pivotally coupled to fastener 906 of DBC 924 and is able to pivot away when latch 908 engages with ramp 912 whereby flexible latch 908 is disconnected from the striker reset hook of striker 916. Fastener 906, in one example, is the middle portion of DBC 924 and it can be located anywhere in DBC 924 depending on the applications.

Ramp 912 is configured to have a slopped surface which is structured to allow flexible latch 908 to move along the slopped surface while gradually releasing striker 916 from DBC 924. Ramp 912, in one aspect, can be part of or coupled to the bolt chamber facilitating disconnection between DBC 924 and striker 916 when flexible latch 908 moves onto the slopped surface of ramp 912. It should be noted that the striker reset hook of striker 916 is configured in such as way that it allows DBC 924 to disconnect from striker 916 as flexible latch 908 moves onto ramp 912. DBC 924 is disconnected from striker 916 after striker 916 is repositioned in a striking or cocking position.

Launcher 900 further includes a bolt reset element 910 coupled to the bolt chamber and is able to reposition bolt 922 to a closed bolt position after a projectile is launched. Bolt reset element 910, in one aspect, is a spring which is able to reposition bolt 922 to a predefined closed position adjacent to a paintball in a firing chamber after flexible latch 908 disconnects from the striker reset hook of striker 916. It should be noted that launcher 900 further includes a valve and a triggering mechanism. For instance, a valve is coupled to a pressurized gas tank and is configured to release a portion of gas for launching a paintball in accordance with a movement of striker 916. The triggering mechanism, on the other hand, is coupled to striker 916 and is configured to control striker 916 for launching paintball 920.

Figure 10:
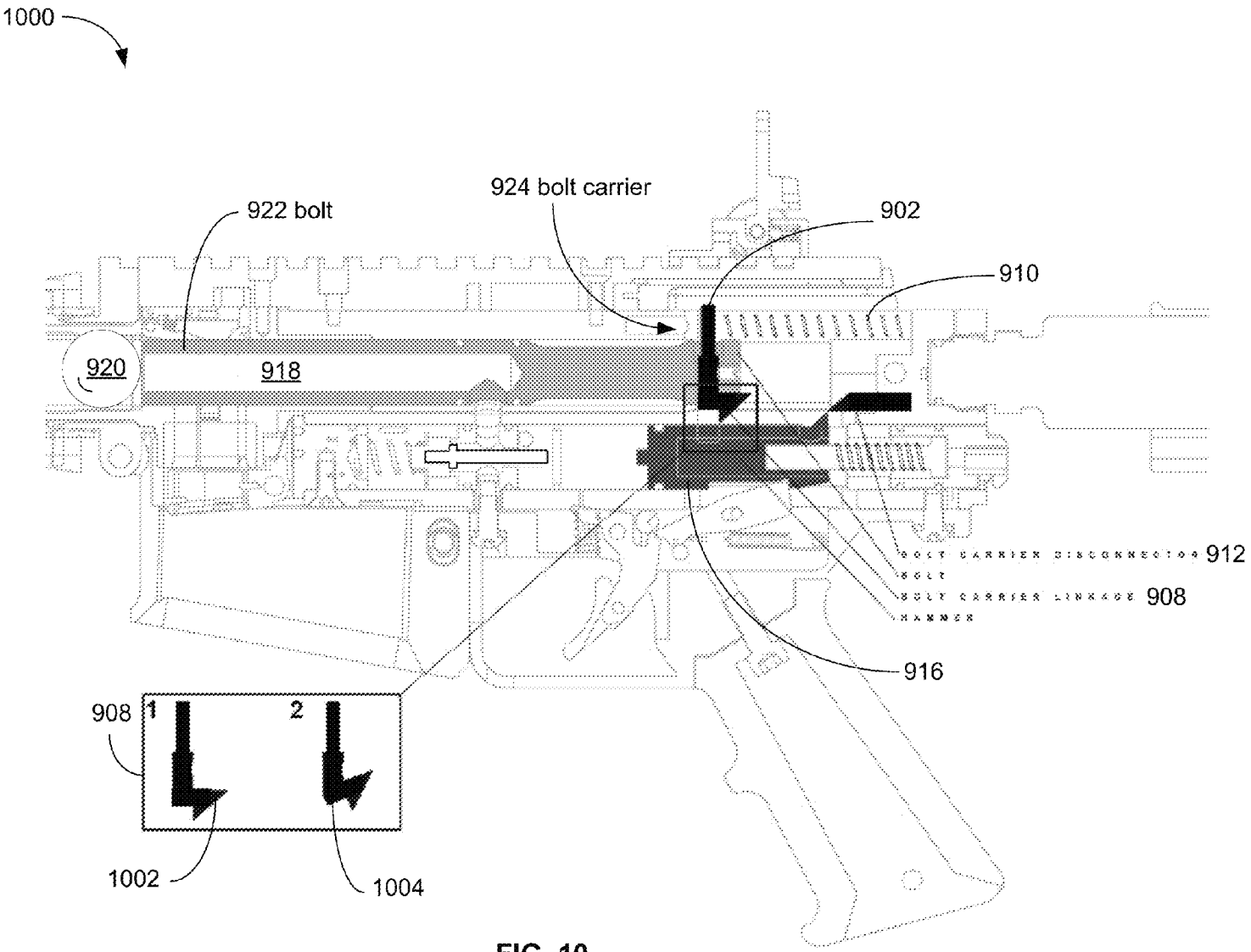
FIG. 10 illustrates a projectile launcher capable of repositioning its bolt in a closed bolt position in accordance with one embodiment of the present invention.

FIG. 10 illustrates a projectile launcher 1000 capable of repositioning its bolt 922 in a closed bolt position in accordance with one embodiment of the present invention. Launcher 1000, which is similar to launcher 900, includes DBC 924, bolt 922, striker 916, bolt reset element 910, and ramp. DBC 924, in one embodiment, includes bolt repositioning latch 902, fastener, and flexible latch 908. It should be noted that flexible latch 908 can also be referred to as bolt carrier linkage, flexible latch, or linkage.

During operation, when flexible latch 908 moves toward ramp 912 prior to contacting ramp 912, flexible latch 908 latches to striker using the engaging formation indicated by numeral 1002. Upon contacting ramp 912, flexible latch 908 is progressively changing its formation from engaging formation to a releasing formation as indicated by numeral 1004 as flexible latch 908 continues to move onto ramp 912. After disconnecting flexible latch 908 from striker 916, bolt reset element 910 such as an elastic spring pushes or repositions bolt 922 to a closed bolt position. In the process of repositioning of bolt 922 to the closed bolt position, projectile such as paintball 920 is pushed into a firing chamber ready to be fired. Consequently, the projectile is loaded into the firing chamber before striker 916 hits the valve. It should be noted that projectile or paintball 920 can travel longer distance with enhanced accuracy if it is launched at the closed bolt position.

An advantage of repositioning bolt 922 to a closed bolt position is that launching from a firing chamber in a closed bolt position enhance projectile or paintball's traveling distance with greater accuracy because the projectile tends to have less surface contact with the inner wall of a barrel before it exits the muzzle. It should be noted that if a projectile is launched from a loading chamber, the launching process involves pushing the projectile by a bolt into the firing chamber first, and then opening the valve to launch the projectile via a stream of pressurized gas. The action of pushing-pluslaunching often causes a projectile to travel less distance with reduced accuracy because the projectile tends to make great contacts to the inner wall of barrel before it exits the muzzle.

Figure 11:
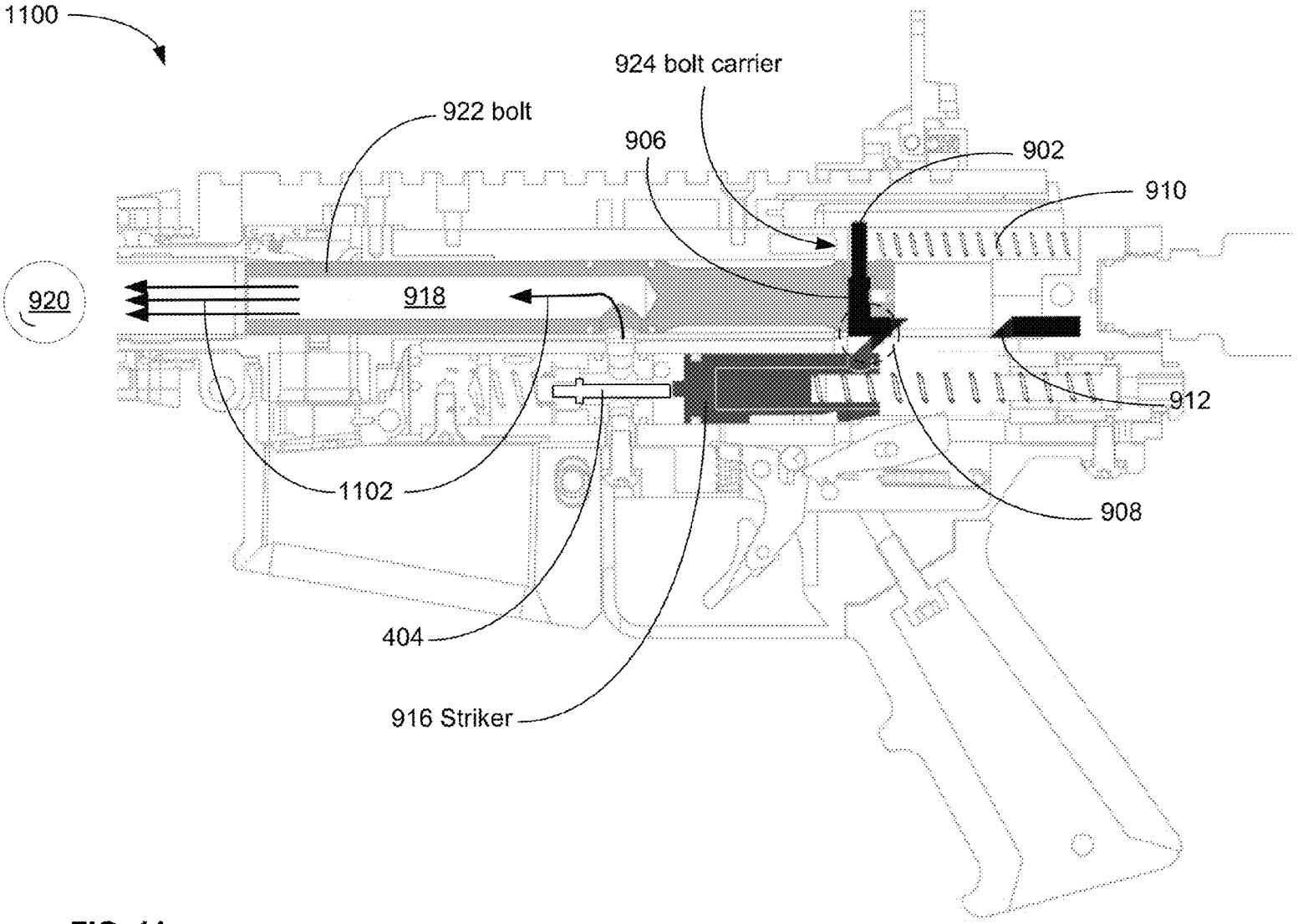
FIG. 11 illustrates a projectile launcher able to launch an object by a bolt via a closed-bolt position in accordance with one embodiment of the present invention.

FIG. 11 illustrates a projectile launcher 1100 able to launch an object by a bolt via a closed-bolt position in accordance with one embodiment of the present invention. Launcher 1100, which is similar to launcher 1000, includes DBC 924, bolt 922, striker 916, bolt reset element 910, and ramp 912. When a user squeezes a trigger which releases striker 916, a pressurized gas stream 1102 is generated due to the push at valve pin 404 by striker 916. Pressurized gas stream 1102 which is guided by air channel 918 launches the object such as a paintball 920 from the firing chamber to a target through a muzzle of barrel. It should be noted that the striker reset hook of striker 916 reconnects with flexible latch 908 at the time striker 916 hits or engages with valve pin 404.

During an operation, a majority portion of pressurized gas stream 1102 is used to propel paintball 920, a small portion of pressurized gas stream 1102 pushes bolt 922 to a direction opposite from the travel direction of paintball 920. When bolt 922 moves in a direction toward ramp 912, bolt carrier 924 carries striker 916 back to its ready to fire position or reset position via flexible latch 908 and the striker reset hook. When striker 916 is reset or cocked, flexible latch 908 releases striker 916 by continuing moving over ramp 912. As soon as bolt carrier 924 is disconnected from striker 916, bolt reset element 910 repositions bolt 922 to a closed bolt position ready for the next launch.

Figure 12:
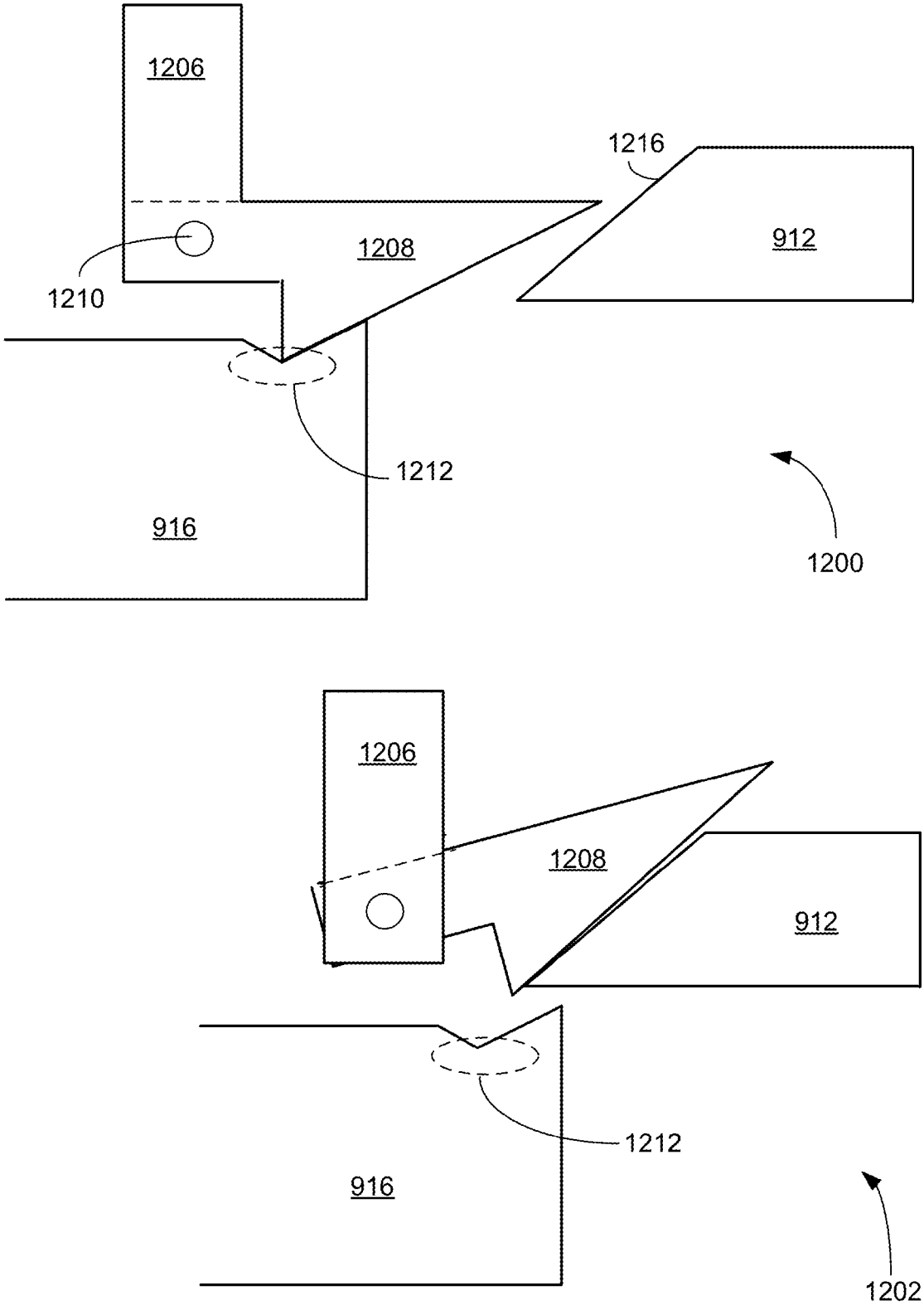
FIG. 12 illustrates block diagrams showing exemplary layouts of flexible latch or flexible bolt linkage in accordance with one embodiment of the present invention.

FIG. 12 illustrates block diagrams 1200-1202 showing exemplary layouts of flexible latch or flexible bolt linkage in accordance with one embodiment of the present invention. Diagram 1200 illustrates an exemplary implementation of flexible latch 908 carries striker 916 to its reset or cocking position. Flexible latch 908, in one embodiment, includes a fixed element 1206 which can be an extension of fastener and a flexible element 1208 wherein elements 1206-1208 are pivotally attached by a flexible latch pin 1210. After launching a paintball, flexible latch 908 latches striker reset hook 1212 and returns striker 916 to its reset or cocking position.

When striker 916 is reset or cocked to its ready to fire position, flexible latch 908 continues to move toward ramp 912 allowing element 1208 to move onto surface 1216 of ramp 912. When element 1208 continues to move onto ramp 912, flexible latch 908 gradually detaches from striker reset hook 1212. When element 1208 raises sufficient amount of height, element 1208 is disconnected from striker reset hook 1212. After disconnecting between moving element 1208 and striker reset hook 1212, bolt can be repositioned to a closed bolt position for the next launch. It should be noted that the underlying concept of the exemplary embodiment(s) of the present invention would not change if other configurations of coupling and/or decoupling mechanism are used for flexible latch 908 to couple to and decouple from striker reset hook 1212.

Figure 13:
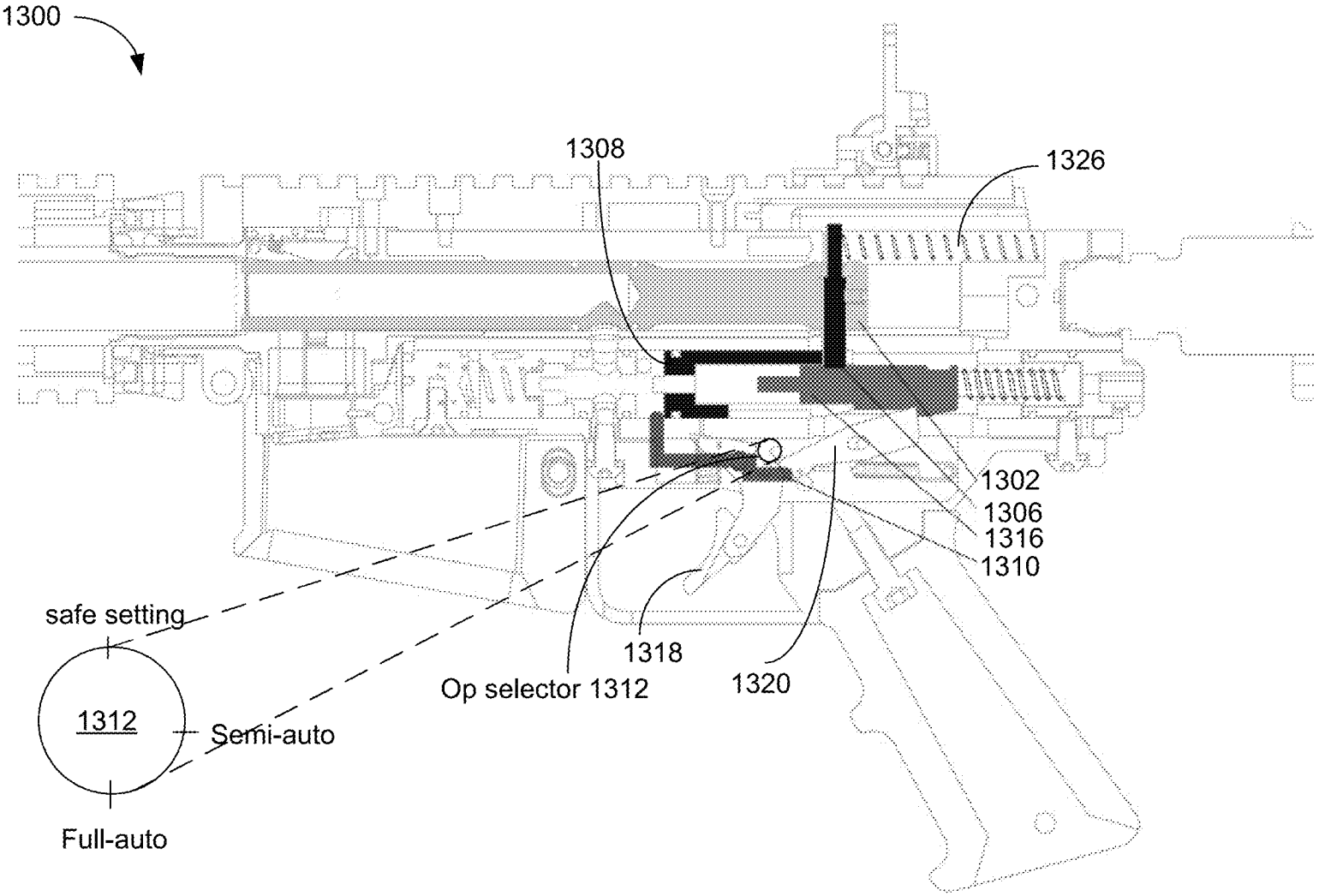
FIGS. 13-14 illustrate a projectile launcher using a bolt carrier extension able to disconnect a bolt carrier from a striker in accordance with one embodiment of the present invention.
Figure 14:
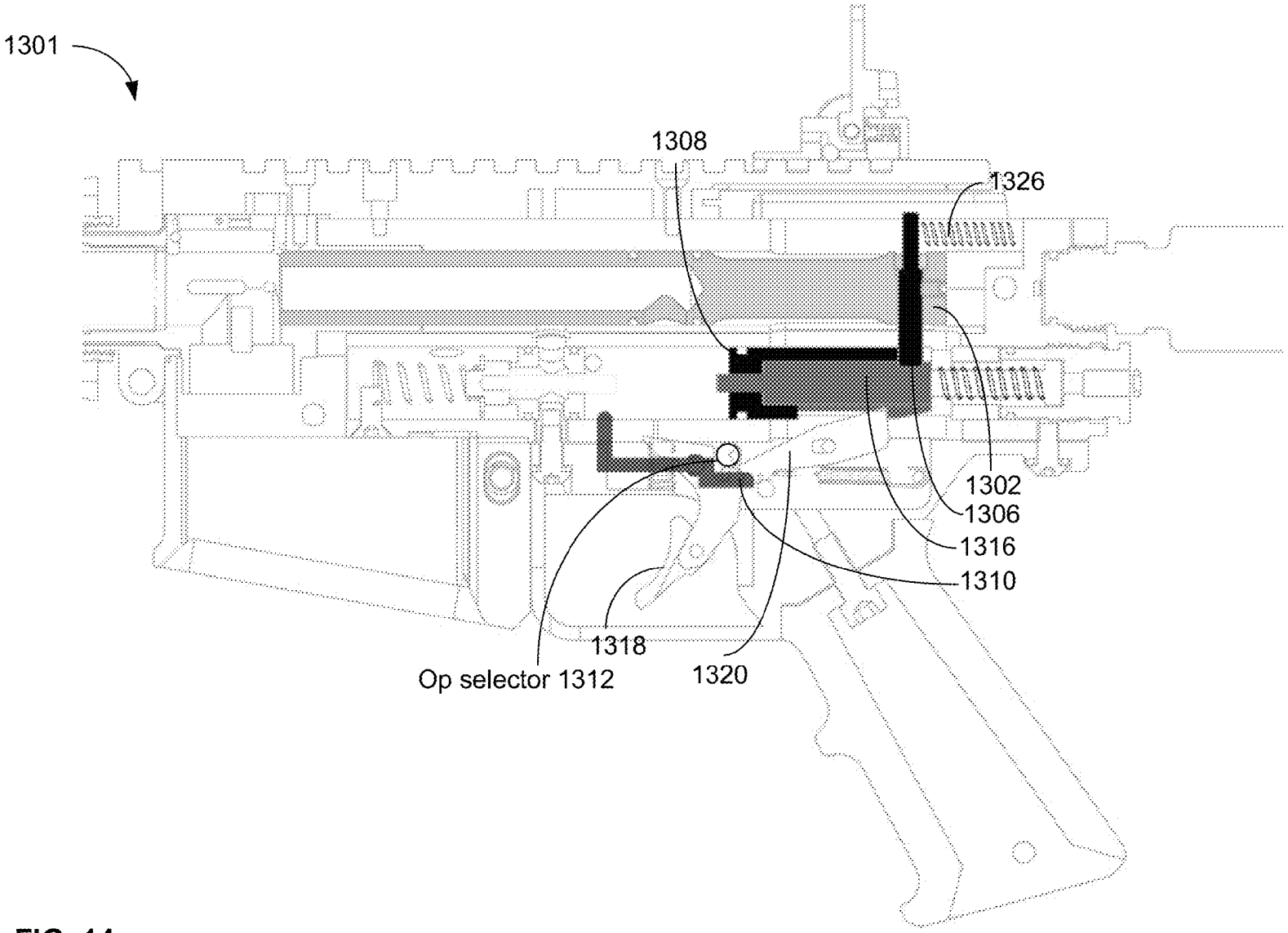

FIGS. 13-14 illustrate a projectile launcher 1300 or 1301 using a bolt carrier extension able to disconnect a bolt carrier from a striker in accordance with one embodiment of the present invention. Launcher 1300 includes bolt 1302, bolt carrier 1306, striker 1316, operation selector 1312, and full-auto disconnector 1310. Bolt carrier 1306, in one embodiment, includes a bolt carrier extension 1308 which is structured as a striker shell or housing capable of resetting or cocking striker 1316 after a launch, as shown in FIG. 14. After resetting striker 1316 to a ready to fire position, bolt carrier extension 1308 is able to release or disconnect from striker 1316. Upon disconnecting from striker 1316, bolt 1302 is able to be repositioned to a closed bolt position. It should be noted that the underlying concept of the exemplary embodiment(s) of the present invention would not change if one or more components (or units) were added to or removed from launcher 1300 or 1301.

Operation selector 1312, in one embodiment, has three (3) modes, namely, safe setting, semi-auto mode, and full-auto mode. A user us able to select one of three operation modes provided by operation selector 1312. The safe setting mode, for instance, indicates that launcher 1300 is operable in a safe mode and launcher 1300 cannot launch any objects or paintballs before the mode changes. Alternatively, the semi-auto setting mode indicates that launcher 1300 is set to a semi-automatic mode for launching objects such as paintballs. If launcher 1300 is set to a full-auto setting mode which means that launcher 1300 can launch paintballs continuously so long as trigger 1318 is squeezed. For example, in a mode of full-auto setting, launcher 1300 can fire objects such as paintballs continuously as long as the trigger is squeezed or pulled.

If a full-auto setting is chosen and trigger 1318 is squeezed, full-auto disconnector 1310, in one embodiment, takes over the auto triggering mechanism. For example, full-auto disconnector 1310 launches an object such as paintball as soon as striker 1316 is cocked and bolt 1302 is repositioned. It should be noted that every time bolt carrier extension 1308 engages or contacts with full-auto disconnector 1310, a paintball is launched. The firing occurs automatically when bolt carrier extension 1308 of bolt 1302 engages with full-auto disconnector 1310 during an operation of repositioning bolt 1302 by a bolt reset spring 1326. The cycle of operation continues until trigger 1318 returns to its ready to fire position.

During an operation, an operator or user selects an operating mode by pivotally rotating or dialing operation selector 1312 to a desirable setting or mode. It should be noted that selections other than safe setting, semi-automatic, or full-auto is possible such as single firing mode. To initiate a cycle of operation with full-auto mode, the user squeezes trigger 1318 which releases striker 1316. When striker 1316 engages with a valve pin, a stream of pressurized gas is gated by the valve to propel an object such as a paintball from a firing chamber to a target. The blowback force created by the launching a paintball pushes bolt 1302 together with bolt carrier 1306 to a direction opposite from a travel direction of the paintball. As bolt 1302 moves toward backside of launcher 1300, bolt carrier extension 1308 catches striker 1316 and moves striker 1316 back to its resetting or cocking position as shown in FIG. 14. Note that striker reset position or cocking position is a condition ready to fire. Once striker 1316 is cocked, bolt reset spring 1326 repositions bolt 1302 to a predefined position such as a closed bolt position. Upon reaching to the predefined position, bolt carrier extension engages or triggers full-auto disconnector 1310. It should be noted that full-auto disconnector 1310 is configured in such a way that one end of disconnector 1310 is in a path of incoming bolt carrier extension 1308 and another end of disconnector 1310 is situated in proximity or vicinity of sear 1320. When one end of disconnector 1310 is engaged or triggered by bolt carrier extension 1308, the other end causes sear 1320 to tilt away from striker 1316 whereby striker 1316 is released. As such, sear 1320 capable of being triggered by bolt carrier extension 1308 reinitiates cycle of operation until trigger 1318 is released or returns to "un-triggering" state. When trigger 1318 is released, full-auto disconnector 1310 disengages from sear 1320 whereby trigger 1318 takes over the control of sear 1320.

Figure 15:
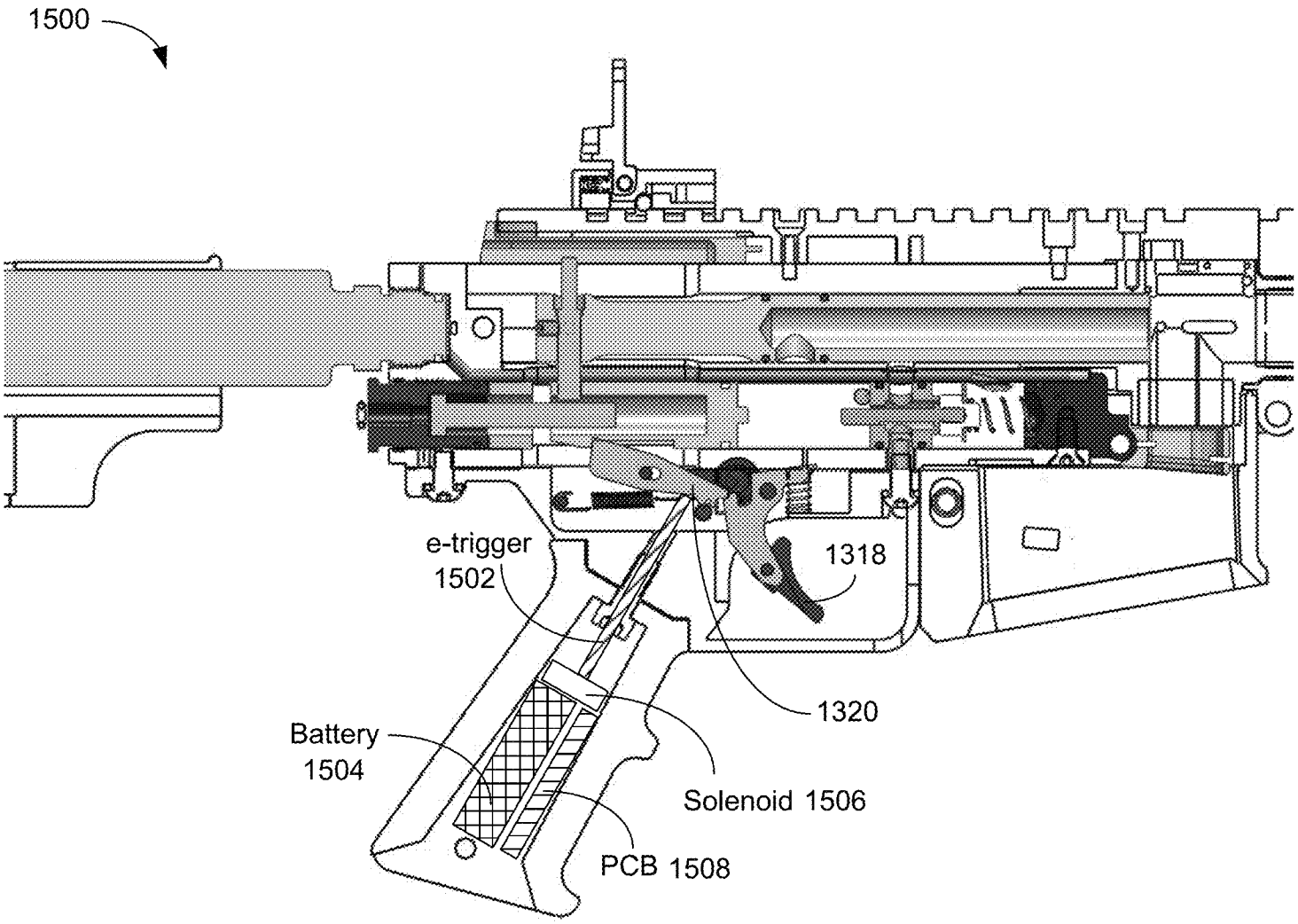
FIG. 15 illustrates a projectile launcher using an electronic triggering mechanism for automatic operation in accordance with one embodiment of the present invention.

FIG. 15 illustrates a projectile launcher 1500 using an electronic triggering mechanism for automatic firing in accordance with one embodiment of the present invention.

Launcher 1500 includes an e-trigger 1502, battery 1504, solenoid 1506, and printed circuit board ("PCB") 1508. PCB 1508, in one embodiment, includes a controller capable of signaling and/or driving solenoid 1506 for firing. Solenoid 1506, in one example, is coupled to e-trigger 1502 and controls behavior of e-trigger 1502. Since e-trigger 1502 controls position of sear 1320, solenoid 1506 indirectly controls the position of sear 1320 which determines when to fire.

After detecting a squeeze of trigger 1318, the controller instructs solenoid 1506 to release or tilt sear 1320 via e-trigger 1502 whereby the striker is released. The cycle of operation can continue as long as the squeezing of trigger 1318 continues. It should be noted that the underlying concept of the exemplary embodiment(s) of the present invention would not change if one or more components (or units) were added to or removed from launcher 1500.

Figure 16:
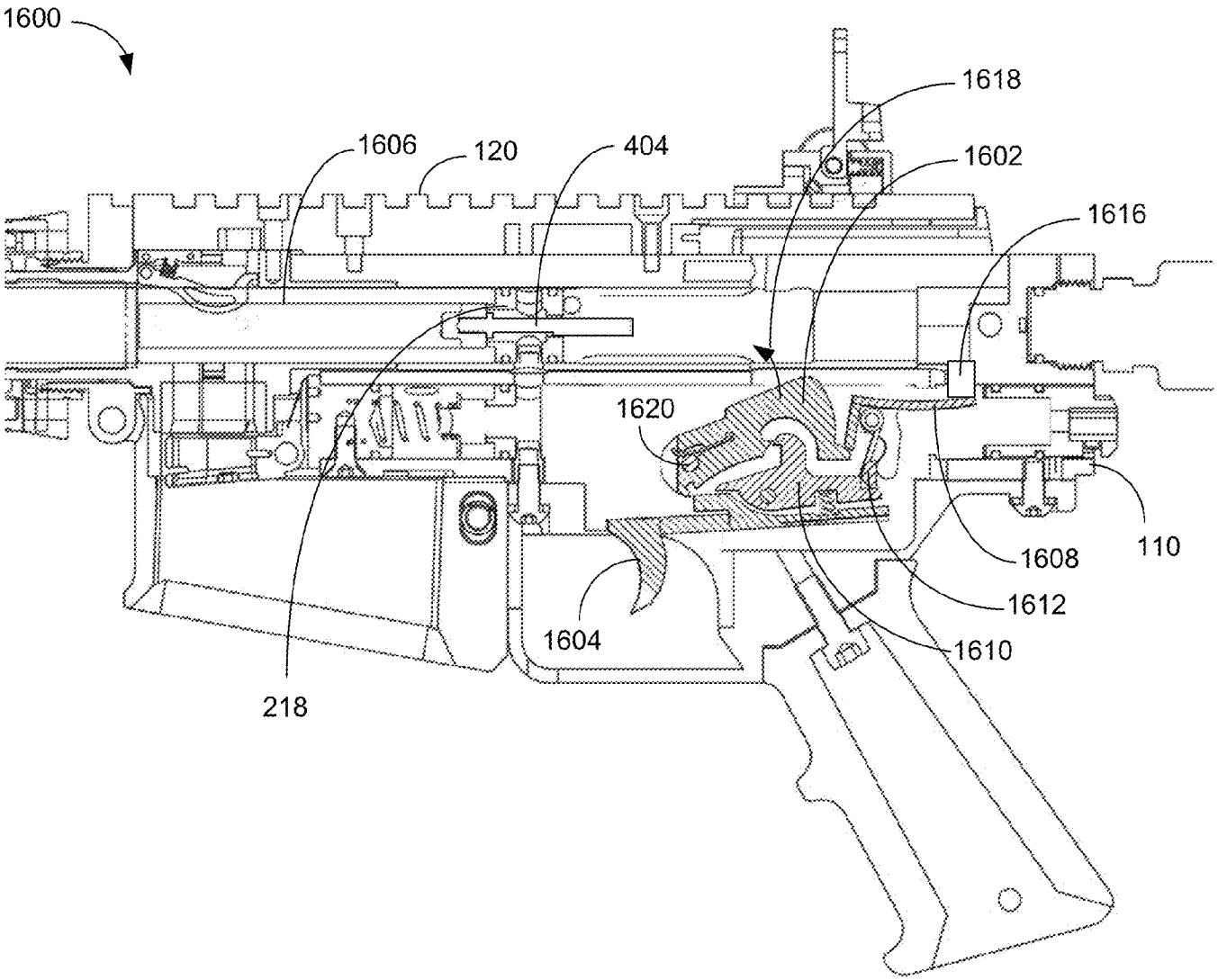
FIGS. 16-17 illustrate a projectile launcher using a hammer to launch a projectile such as a paintball via a swing motion of the hammer in accordance with one embodiment of the present invention.
Figure 17:
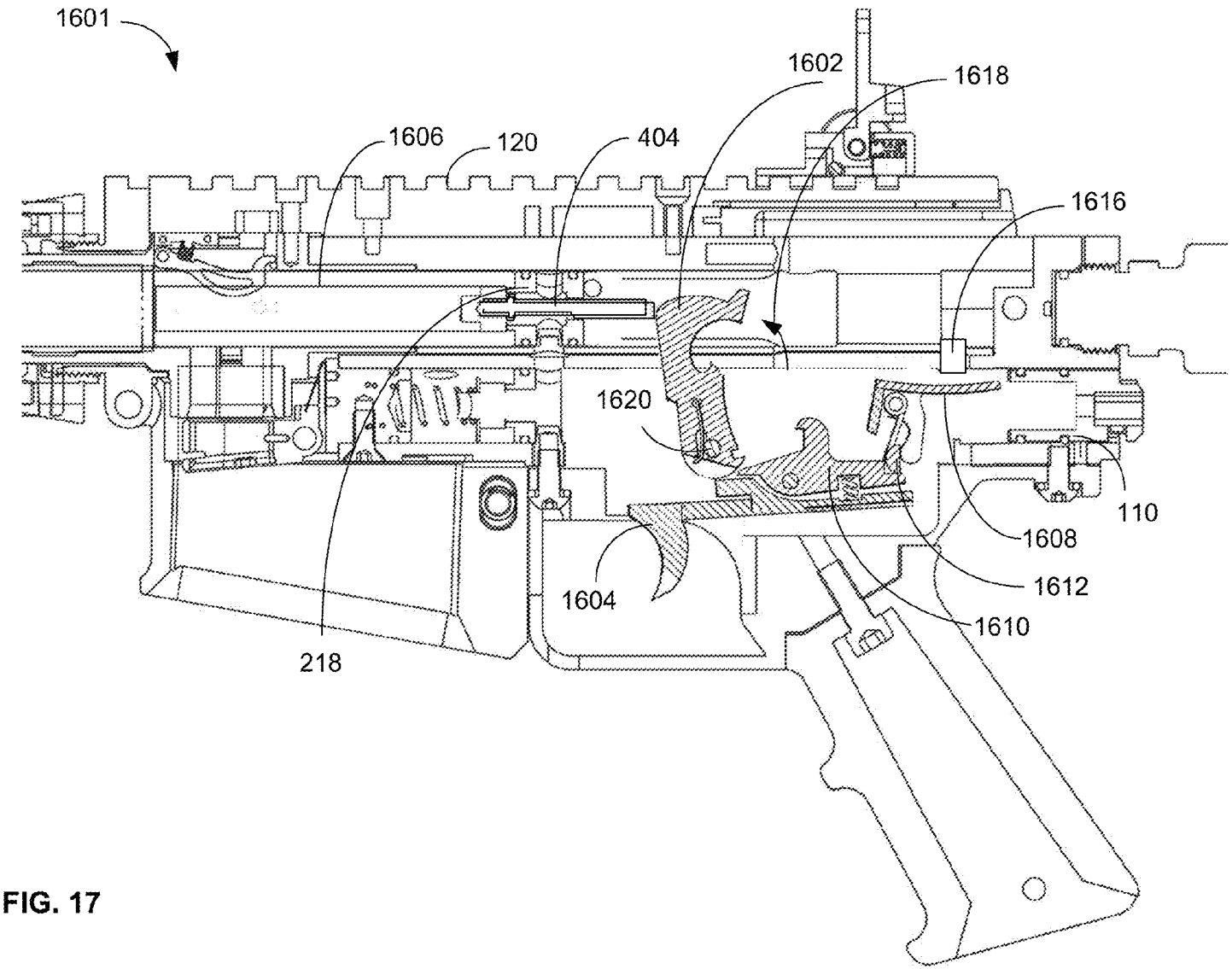

FIGS. 16-17 illustrate a projectile launcher 1600 or 1601 using a hammer to launch a projectile such as a paintball via a swing motion of the hammer in accordance with one embodiment of the present invention. Launcher 1600 or 1601 includes bolt 1606, hammer 1602, trigger 1604, and sear 1610. In one embodiment, launcher 1600 further includes an operation switch 1612 and a flexible automatic operation ("auto-op") lever 1608. In one aspect, hammer 1602 is in reset and cocked position which is a ready to fire position. FIG. 17 shows launcher 1601 illustrating hammer 1602 that is in a striking position or in a position engaging with valve pin 404. It should be noted that the underlying concept of the exemplary embodiment(s) of the present invention would not change if one or more components (or units) were added to or removed from launcher 1600 or 1601.

Bolt 1606, in one example, contains an air channel and includes a hammer reset element 1616 able to cock the hammer to its ready for firing position during a launch process. The bolt chamber includes a hammer groove permitting a portion of hammer 1602 to temporary pass through the hammer groove during a swing motion as indicated by numeral 1618 created by hammer 1602. Bolt 1606, in one example, is capable of being repositioned to a closed bolt position adjacent to a projectile in a firing chamber in response to a repositioning spring. In one aspect, auto-op lever 1608 is structured with a first end and a second end wherein auto-op lever 1608 is configured in such a way that the first end of auto-op lever is triggerable by a movement of bolt repositioning. When a full-auto firing mode is selected, the second end of auto-op lever 1608 is able to release hammer 1602 in response to the movement of the first end of auto-op lever. For example, the movement of the first end can be triggered by the repositioning movement of the bolt whereby the second end releases hammer 1602 to launch the loaded projectile.

Valve 218 is coupled to the air channel of bolt 1606 for controlling pressurized gas and is situated in a firing control chamber. Note that the firing control chamber is situated or arranged in parallel to the bolt chamber. Valve 218 includes a valve pin 404 which is a contact point to hammer 1602. When hammer 1602 strikes valve pin 404, valve pin 404 opens valve 218 which allows a stream of pressurized gas to flow from a pressurized chamber to the gas channel in bolt 1606. Upon arrival of pressurized gas, the projectile is launched.

Hammer 1602 is configured to have a pivot hole located at one end of hammer 1602. The pivot hole is used for hosting hammer pivot pin 1620 for facilitating swing motion 1618 around hammer pivot pin 1620. Hammer 1602, in one example, is situated in the firing control chamber and is made of metal material having sufficient weight to move or open valve pin 404 when hammer 1602 strikes pin 404. Hammer 1602, in one aspect, is structured having substantially rectangular shape wherein one end of rectangular is used to couple to hammer pivot pin 1620 for facilitates swinging motion 1618 while the other end is used to make the contact with valve pin 404. Hammer 1602, alternatively, is configured or fabricated having an irregular elongated shape wherein one end of hammer couples to hammer pivot pin 1620 capable of facilitating swinging motion 1618 and other end makes contact to valve pin 404.

Launcher 1600 or 1601 further includes a trigger 1604 coupled to hammer 1602 and able to activate hammer 1602 for firing. It should be noted that launcher 1600 should further include a pressurized gas tank and a triggering mechanism. The pressurized gas tank, for example, is coupled to valve 218 and is configured to provide pressurized gas for launching projectiles or paintballs in response to hammer 1602. The triggering mechanism is configured to control motion of hammer 1602 for paintball launching.

Operation switch 1612 is used to select one of several available operating mode such as a single firing mode or full-auto firing mode. If launcher 1600 is set to a full-auto firing mode, launcher 1600 can launch paintballs continuously. For example, in a full-auto firing mode, launcher 1600 can fire objects such as paintballs continuously as long as the trigger is squeezed or pulled. In full-auto firing mode, sear 1610 is tilted or shifted as shown in FIG. 16 or 17 to disengage with hammer 1602 and auto-op lever 1608 takes over the control of hammer's movement. In one aspect, auto-op lever 1608 is able to temporary hold hammer 1602 in a cocked position long enough to allow bolt 1606 is repositioned to a closed bolt position.

Figure 18:
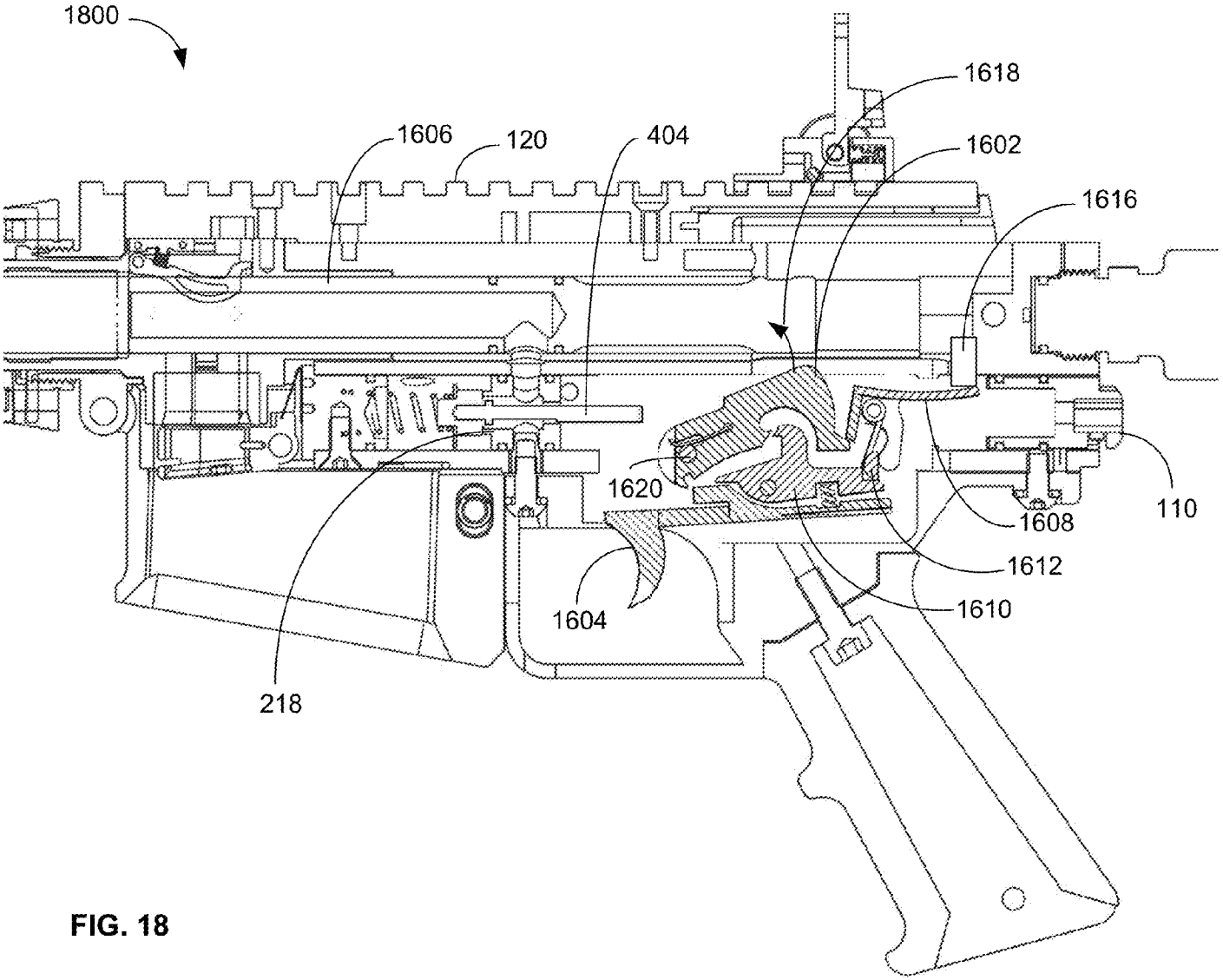
FIGS. 18-19 illustrate a projectile launcher using a hammer to launch a paintball in accordance with one embodiment of the present invention.
Figure 19:
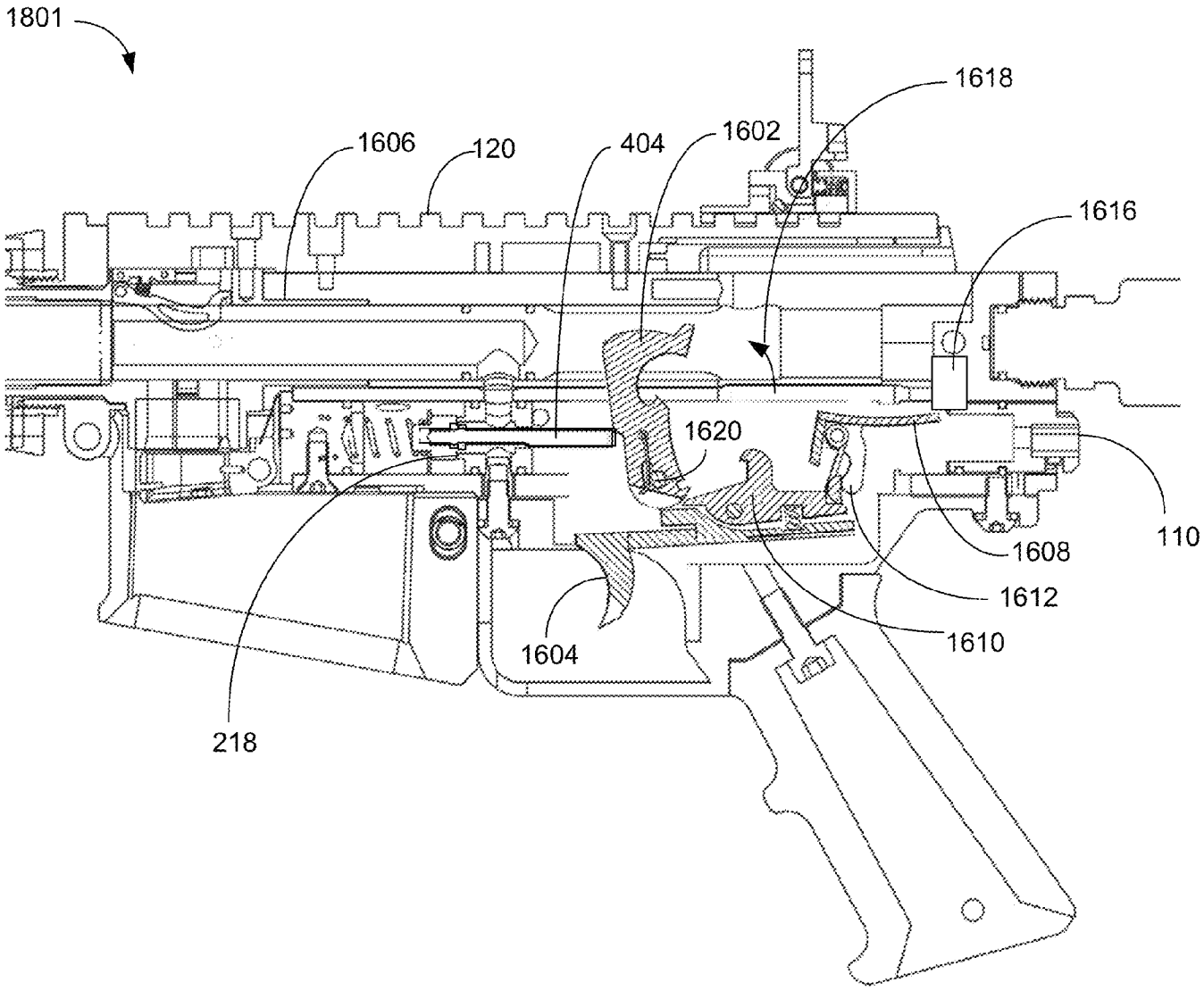

FIGS. 18-19 illustrate a projectile launcher 1800 or 1801 using a hammer to launch a paintball in accordance with one embodiment of the present invention. Launcher 1800 or 1801, which is similar to launcher 1600, includes bolt 1606, hammer 1602, trigger 1604, and sear 1610. Also, launcher 1800 further includes operation switch 1612 and auto-op lever 1608. In one aspect, hammer 1602 illustrated in FIG. 18 is in reset position or ready to fire position. In FIG. 19, launcher 1801 shows hammer 1602 in a striking position or in a position engaging with valve pin 404 for launching a paintball. It should be noted that the underlying concept of the exemplary embodiment(s) of the present invention would not change if one or more components (or units) were added to or removed from launcher 1800 or 1801.

A projectile launching 1800 or 1801, in one embodiment, includes an upper receiver 120 and a lower receiver 110 wherein valve 218 is situated in lower receiver 110. Bolt 1606 is able to move inside of a bolt chamber wherein both bolt 1606 and the bolt chamber are structured with a hammer groove permitting at least a portion of hammer 1602 to travel through the groove when hammer 1602 creates a swing motion as indicated by numeral 1618.

Valve 218 is coupled to the air channel of bolt 1606 via gas channels located in upper receiver 120 and lower receiver 110 for controlling and channeling pressurized gas. Lower receiver 110 includes the firing control chamber and triggering mechanism wherein the triggering mechanism includes trigger 1604 and hammer 1602. Hammer 1602 is configured to strike valve pin 404 of valve 218 situated in lower receiver 110. Upon engaging valve pin 404, valve 218 gates or channels a stream of pressurized gas flowing from a pressurized chamber located in lower receiver 110 to the air channel of bolt 1606 located in upper receiver 120.

One end of hammer 1602 has a pivot hole for pivotally anchoring hammer 1602 to lower receiver 110 via a hammer pivot pin 1620. The location and configuration of pivot hole together with hammer pivot pin 1620 facilitates a swing motion 1618 of hammer 1602 around hammer pivot pin 1620. While one end of hammer 1602 is used for pivotal motion with hammer pivot pin 1620, the other portion of hammer 1602 such as middle part or top end which is opposite end containing pivot hole is used for striking. For example, the middle part of hammer 1602 may be used to strike a valve that is located in lower receiver 110 as shown in FIG. 19. Alternatively, the upper portion which is the opposite end of hammer 1602 having a pivot hole may be used to strike a valve that is located in upper receiver 120 as illustrated in FIG. 17. It should be noted that hammer 1602 can have different shapes and/or configurations as long as it can perform similar function(s) as described above.

Figure 20:
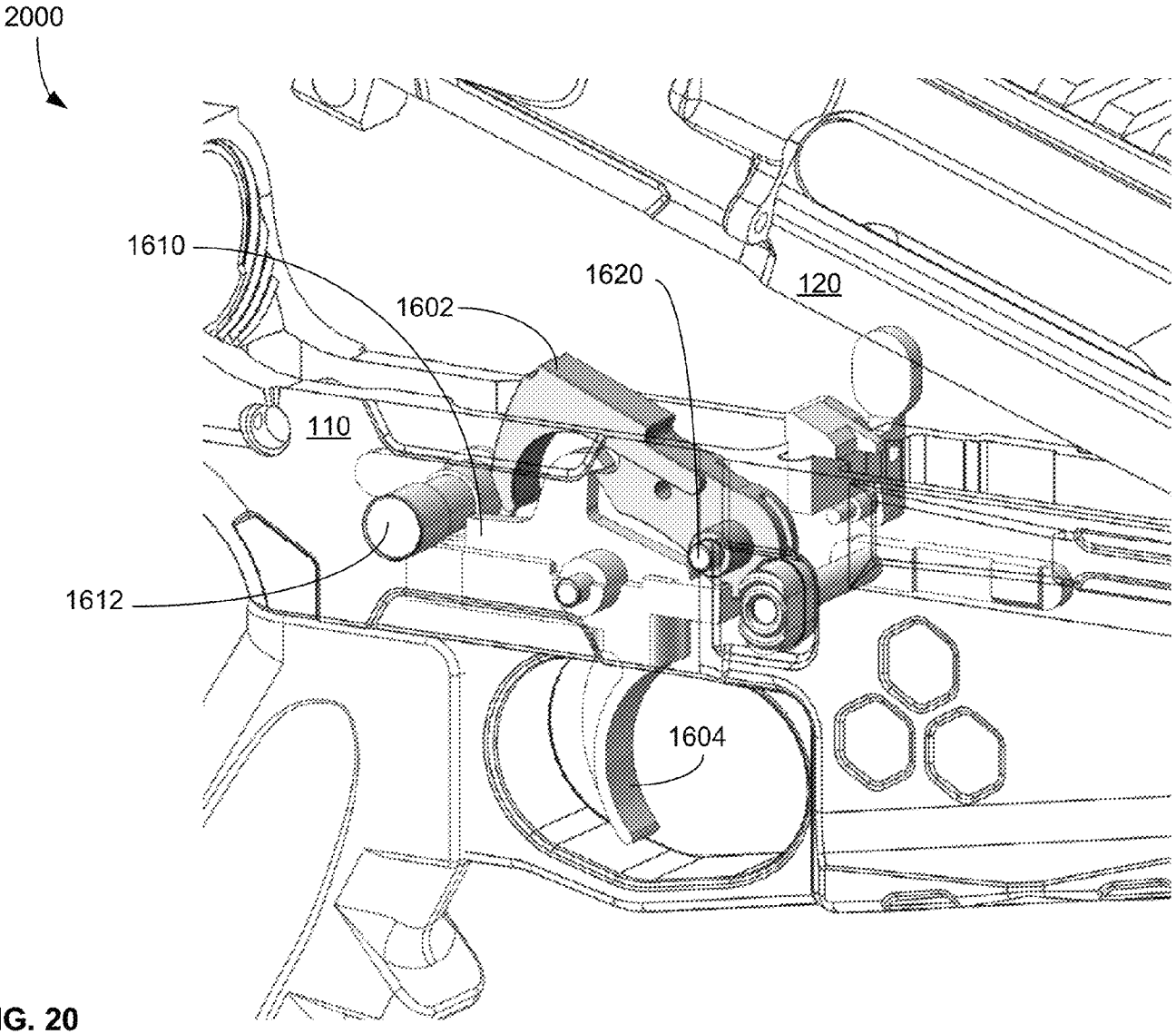
FIGS. 20-21 are 3D diagrams illustrating a projectile launcher using a hammer to launch a paintball in accordance with one embodiment of the present invention.
Figure 21:
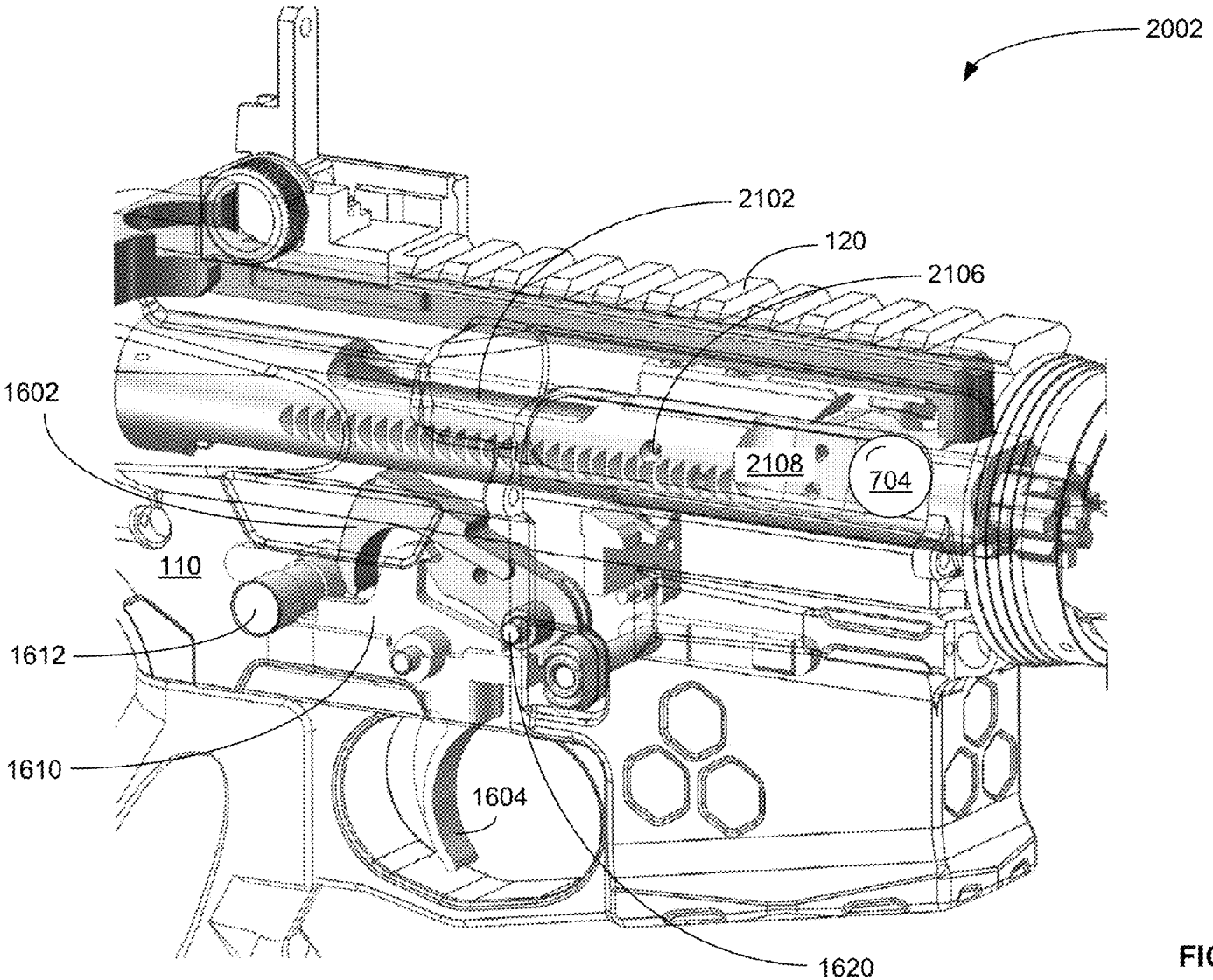

FIGS. 20-21 are 3D diagrams illustrating a projectile launcher 2000 or 2002 using a hammer to launch a paintball in accordance with one embodiment of the present invention. Launcher 2000 or 2002, which is similar to launcher 1600, includes bolt 2108, hammer 1602, trigger 1604, and sear 1610. In one embodiment, launcher 2000 or 2002 further includes an operation switch 1612 which allows a user to select different operating modes such as semi-automatic mode or full automatic mode. Hammer 1602 is in reset position or ready to fire position. It should be noted that the underlying concept of the exemplary embodiment(s) of the present invention would not change if one or more components (or units) were added to or removed from launcher 2000 or 2002.

Launcher 2002 includes upper receiver 120 and lower receiver 110 wherein upper receiver 120 includes bolt 2108 and projectile 704. Bolt 2108, in one embodiment, includes a hammer groove 2102 that allows a portion of hammer 1602 to pass through before it strikes a valve located inside of bolt 2108 as indicated by numeral 2106. Launcher 2002 illustrates that upper receiver 120 and lower receiver 110 are in closed or coupled position. Launcher 2000 illustrates that upper receiver 120 and lower receiver 110 are in open position.

Figure 22:
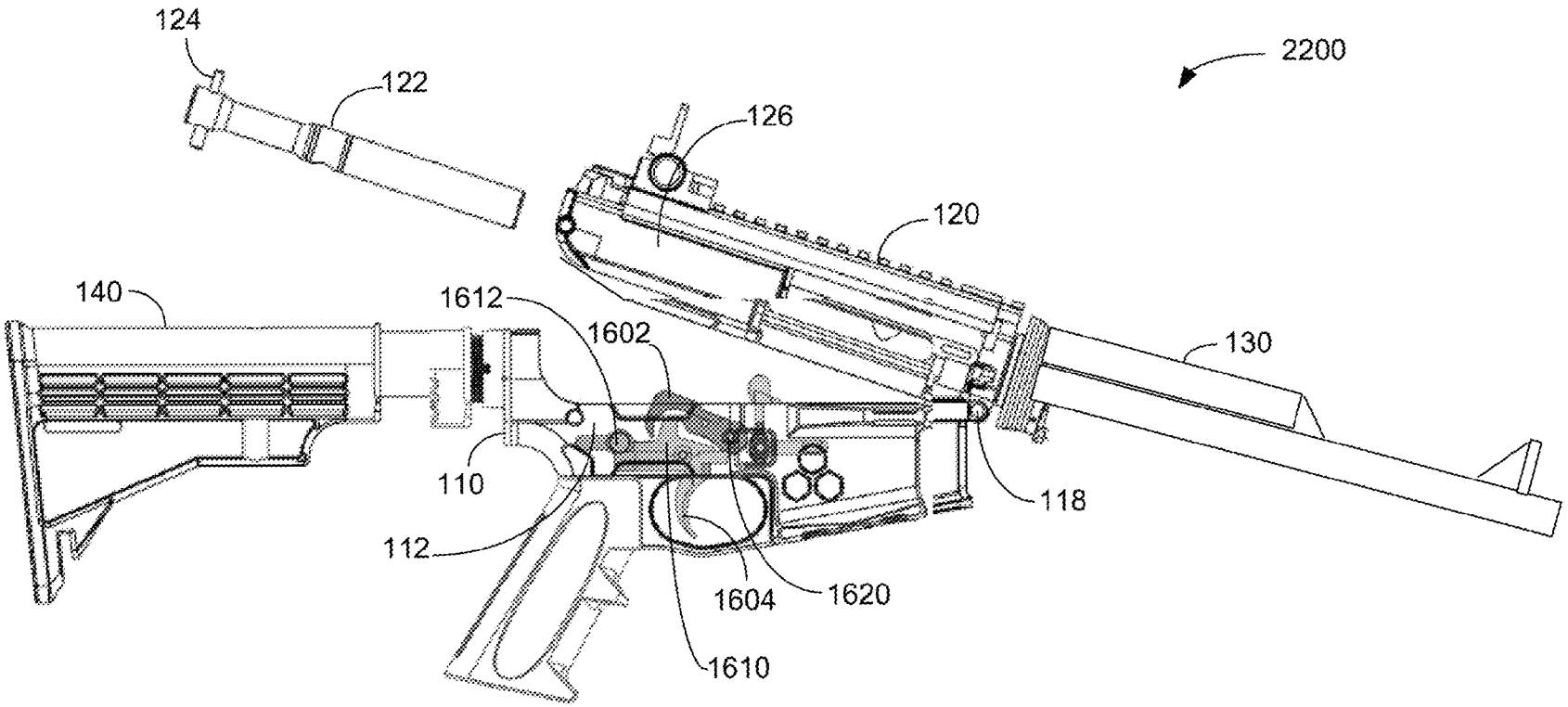
FIG. 22 is a diagram illustrating a projectile launcher using a hammer located in a lower receiver for launching a projectile in accordance with one embodiment of the present invention.

FIG. 22 is a diagram illustrating a projectile launcher 2200 using a hammer located in a lower receiver for launching a projectile in accordance with one embodiment of the present invention. Launcher 2200, which is similar to the launcher illustrated in FIG. 1A, includes an upper receiver 120, lower receiver 110, barrel 130, and buttstock 140, wherein the launcher is in an open position. Upper receiver 120 can pivot around pivot pin 118. It should be noted that the underlying concept of the exemplary embodiment(s) of the present invention would not change if one or more components (or units) were added to or removed from launcher 2200.

While upper receiver 120 includes a bolt chamber 126 configured to house bolt 122, lower receiver includes a firing control chamber 112 which includes a triggering mechanism. The triggering mechanism, in one aspect, includes hammer 1602, trigger 1604, and sear 1610. Launcher 2200 further includes an operation switch 1612 which allows a user to select between semi-automatic mode and full automatic mode. Hammer 1602 is in reset position or ready to fire position. Upon squeezing trigger 1604, hammer 1602 is released. When hammer 1602 strikes a valve, a stream of pressurized gas is released and a projectile is subsequently launched in response to the stream of pressurized gas.

Figure 23:
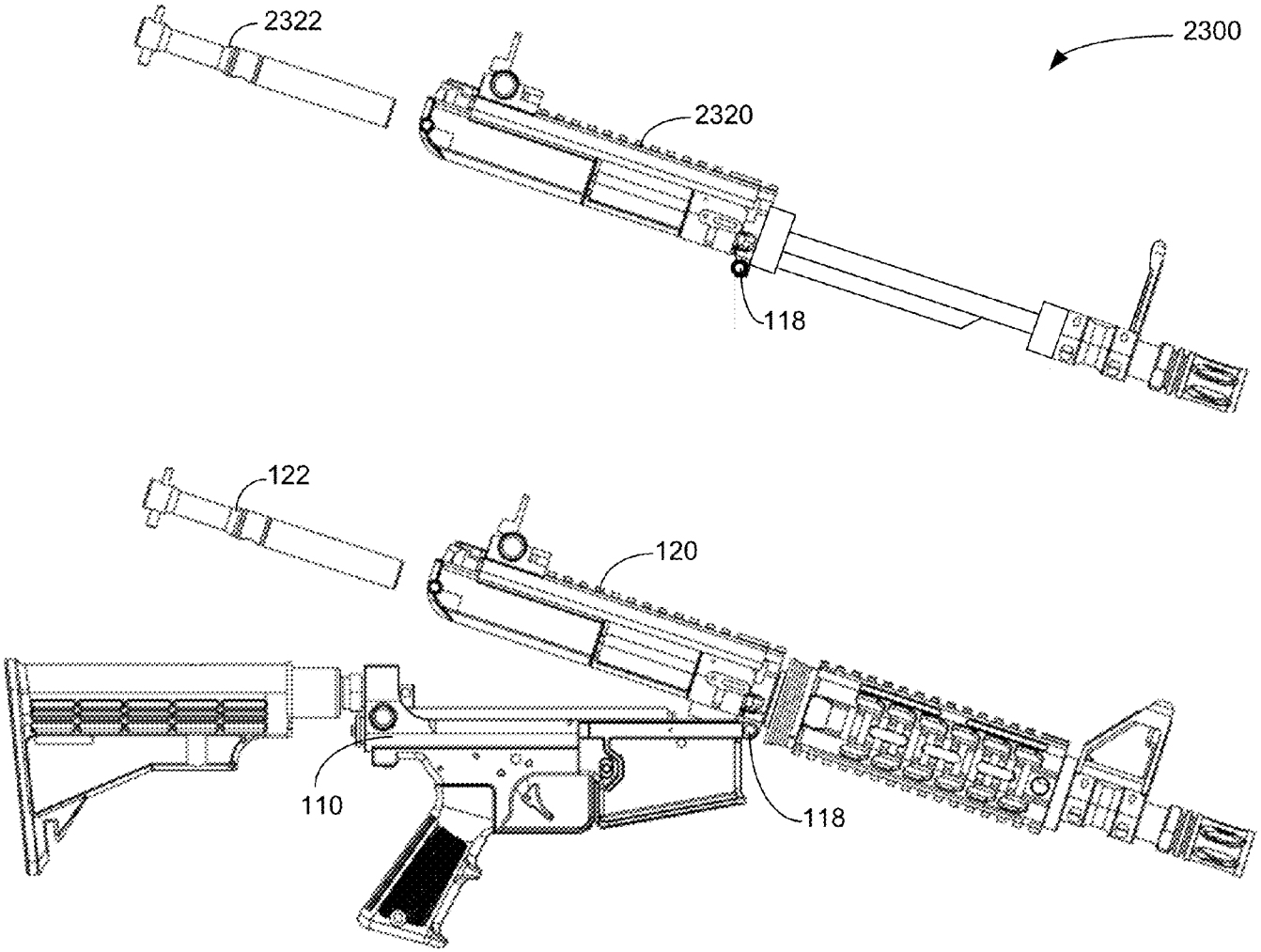
FIG. 23 is a diagram illustrating a projectile launcher able to adapt different upper receiver with the same lower receiver for launching a paintball in accordance with one embodiment of the present invention.

FIG. 23 is a diagram illustrating a projectile launcher 2300 able to adapt different upper receiver with the same lower receiver for launching projectiles in accordance with one embodiment of the present invention. Launcher 2300, which is similar to launcher 2200 illustrated in FIG. 22, includes an upper receiver 120 and lower receiver 110 wherein the launcher is in an open position. Upper receiver 120 is able to pivotally swing open around pivot pin 118. Depending on applications, a user can retrofit a different upper receiver such as receiver 2320 having a bolt 2322 in place of upper receiver 120. It should be noted that the underlying concept of the exemplary embodiment(s) of the present invention would not change if one or more components (or units) were added to or removed from launcher 2300.

An advantage of using retrofittable upper and/or lower receiver is that if an upper receiver or lower receiver is damaged. Instead of buying an entire new gun, just the replacement of damaged part(s) such as new upper receiver is need. Also, depending on the applications such as sniper training, a different type of upper receiver which provides longer distance with greater accuracy is needed. In addition, if a new design of upper receiver is newly released, instead of buying the entire gun, just replacing or retrofitting the new upper receiver is needed.

The exemplary aspect of the present invention includes various processing steps, which will be described below. The steps of the aspect may be embodied in machine and/or mechanical operations. Alternatively, the steps of the exemplary aspect of the present invention may be performed by specific components that contain structural devices for performing the steps.

Figure 24:
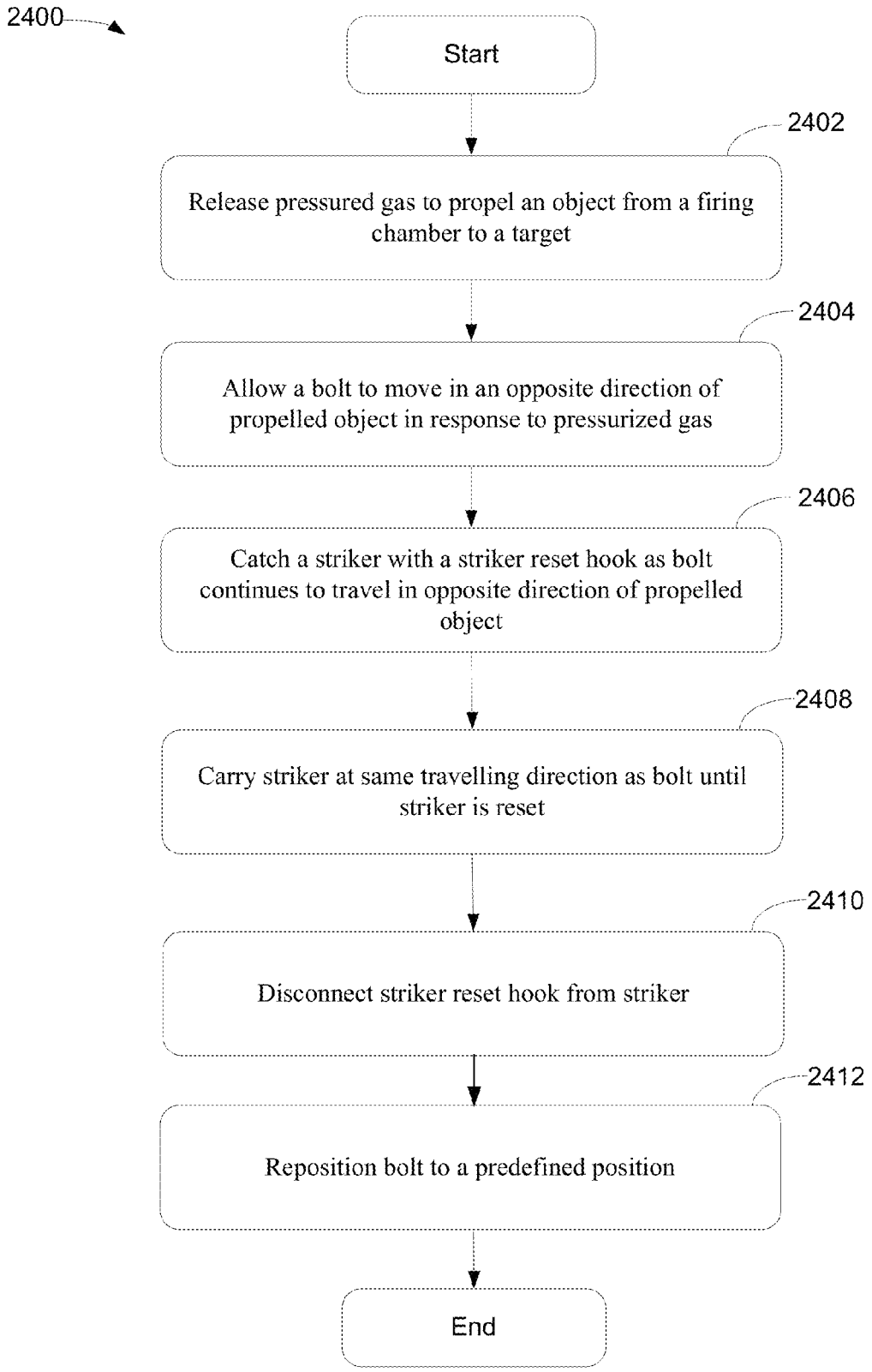
FIG. 24 is a flowchart illustrating a process of resetting a striker and repositioning a bolt during a process of paintball launch in accordance with one embodiment of the present invention.

FIG. 24 is a flowchart 2400 illustrating a process of resetting a striker and repositioning a bolt during a process of paintball launch in accordance with one embodiment of the present invention. At block 2402, a process of launching a projectile such as a paintball releases a stream of pressurized gas to propel an object from a firing chamber to a target. For example, a projectile launcher such as paintball marker launches a projectile such as paintball to a distance target. The process, at block 2404, allows a bolt to move in an opposite direction of propelled object in response to blowback force created by pressurized gas. The bolt, at block 2406, uses a bolt carrier to catch the striker via a striker reset hook and carries the striker as the bolt continues to travel in the opposite direction of propelled object. At block 2408, the striker travels at the same direction as the bolt until the striker reaches at a reset location. Upon arrival to the reset location, the striker is reset to a ready to fire position. After disconnecting the bolt from the striker via a ramp at block 2410, the process, at block 2412, is able to reposition the bolt to a predefined position for the next firing. In one aspect, the process is able to push the bolt next to a paintball in a firing chamber via an elastic force.

Figure 25:
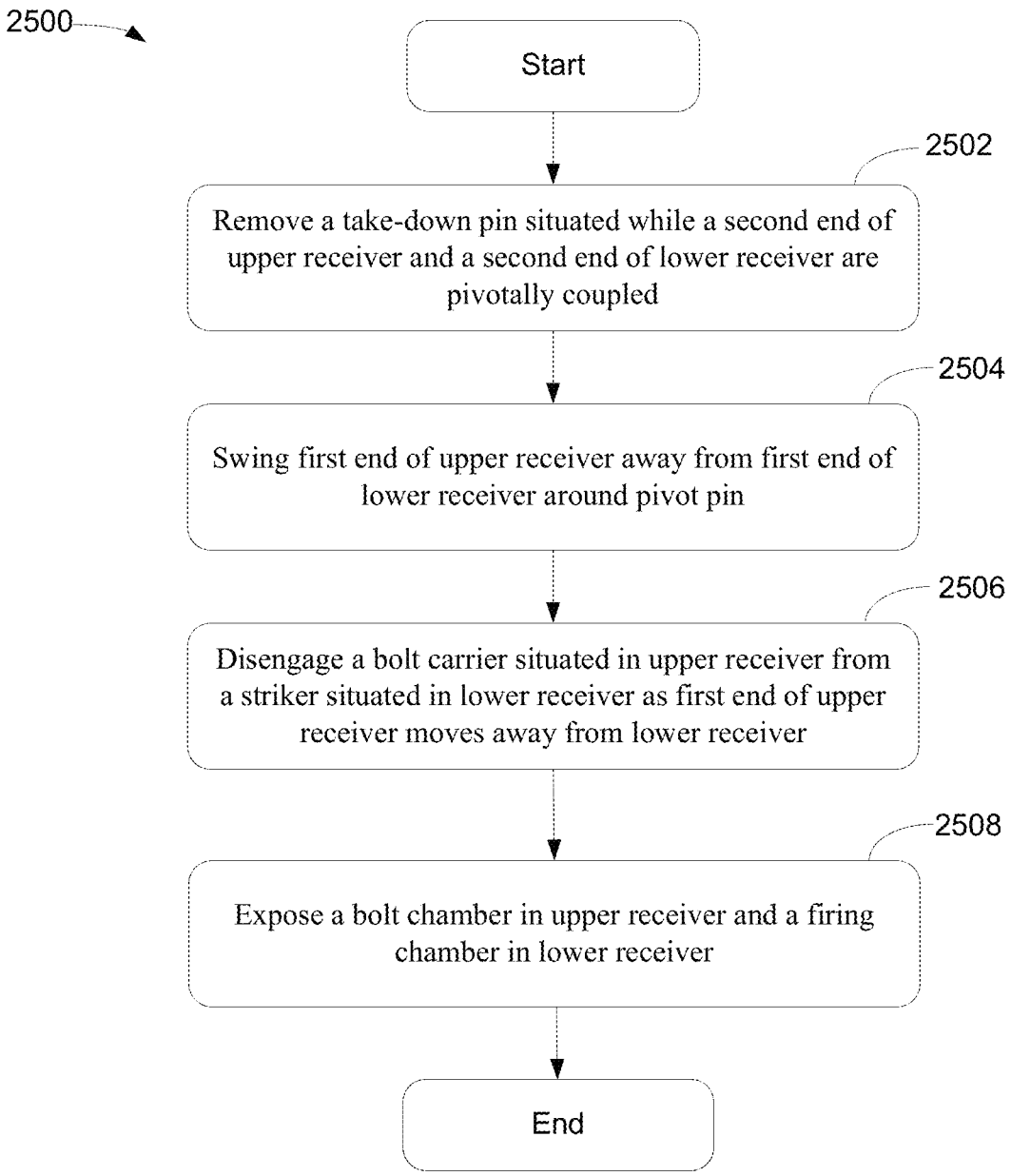
FIG. 25 is a flowchart illustrating a process of separating an upper receiver from a lower receiver of a projectile launcher in accordance with one embodiment of the present invention.

FIG. 25 is a flowchart 2500 illustrating a process of separating an upper receiver from a lower receiver of a projectile launcher in accordance with one embodiment of the present invention. At block 2502, a process or method of opening a projectile launcher such as paintball gun organized in an upper receiver and lower receiver removes a take-down pin situated closer to the buttstock of the launcher. Note that first end of an upper receiver and the first end of the lower receiver are coupled by the take-down pin while the second end of the upper receiver and the second end of the lower receiver are pivotally coupled by a pivot pin.

At block 2504, the first end of the upper receiver is swung away from the first end of the lower receiver around the pivot pin. The bolt carrier, at block 2506, disengages from the striker situated in the lower receiver as the first end of the upper receiver moves away from the lower receiver. At block 2508, the bolt chamber is exposed in the upper receiver and a firing chamber in the lower receiver. In one embodiment, the second gas channel in the upper receiver also disengages from the first gas channel in the lower receiver as the first end of the upper receiver moves away from the first end of the lower receiver. When the paintball gun is in an open position, a bolt with bolt carrier can be removed from the bolt chamber.

To close the projectile launcher, the first end of the upper receiver is moved toward the first end of the lower receiver around the pivot pin. At least a portion of the bolt carrier situated in the upper receiver begins to engage with the striker situated in the lower receiver as the first end of the upper receiver continues moving closer to the lower receiver. The second gas channel in the upper receiver is subsequently coupled to the first gas channel in the lower receiver as the first end of the upper receiver moves closer to the first end of the lower receiver. When the paintball marker is in closed position, the take-down pin is reinserted to secure the upper receiver to the lower receiver as single operable piece.

Figure 26:
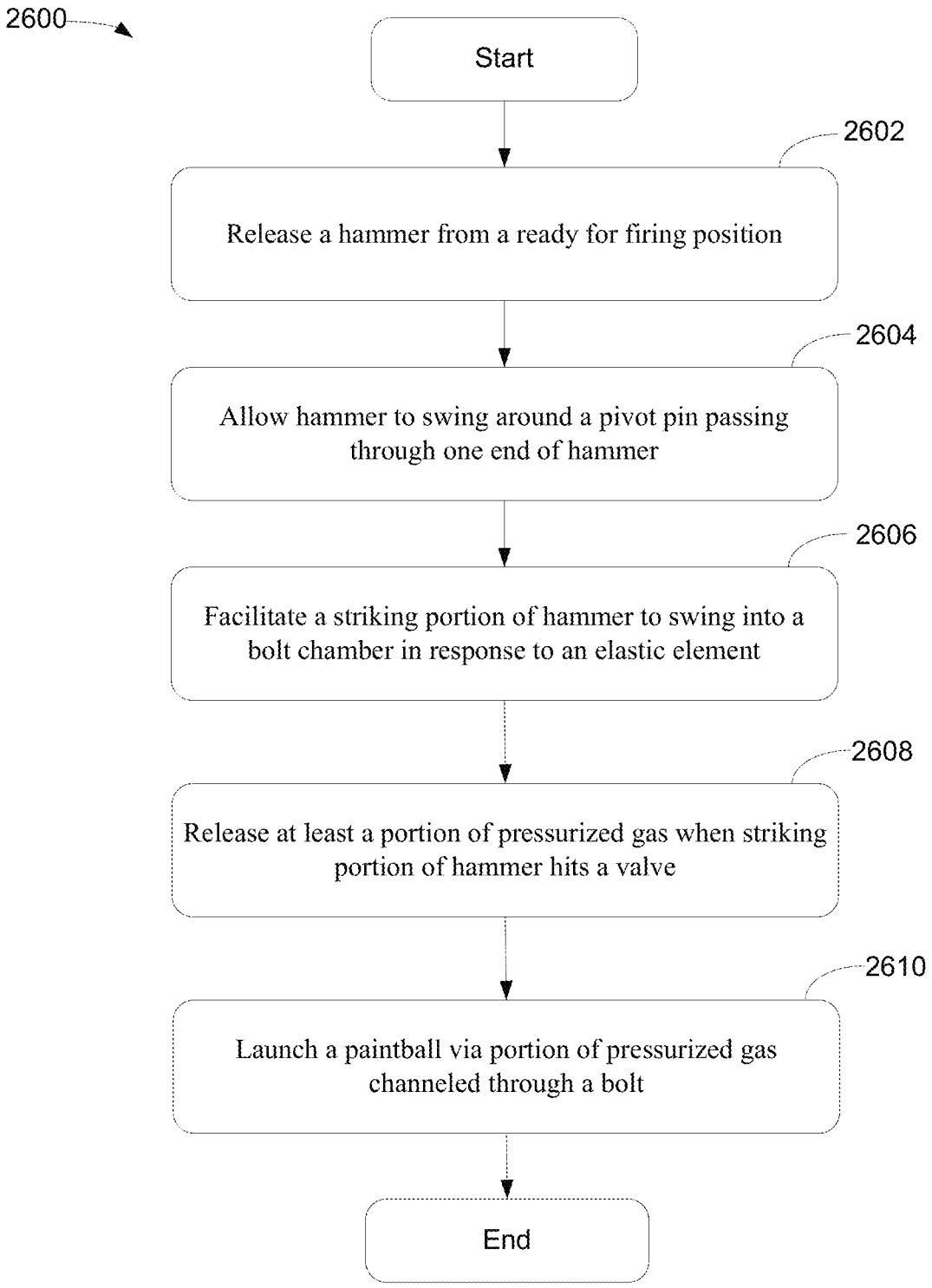
FIG. 26 is a flowchart illustrating a process of employing a hammer to launch a paintball in accordance with one embodiment of the present invention.

FIG. 26 is a flowchart 2600 illustrating a process of employing a hammer to launch a paintball in accordance with one embodiment of the present invention. At block 2602, a process of launching a paintball releases a hammer from a ready to fire position. The hammer, at block 2604, allows to be swung around a hammer pivot pin passing through one end of the hammer. A portion of hammer, at block 2606, passes through a groove in the bolt chamber as well as bolt in response to an elastic element such as a spring. At least a portion of pressurized gas, at block 2608, is gated when the striking portion of the hammer hits the valve. A projectile such as a paintball, at block 2610, is launched via the pressurized gas channeled through a bolt. Note that after resetting the hammer to the ready to fire position via a blowback movement of the bolt during a launching process, the bolt is repositioned to a predefined position for the next launch. For example, the bolt is repositioned to a closed bolt position adjacent to a paintball before next launch.

Figure 27:
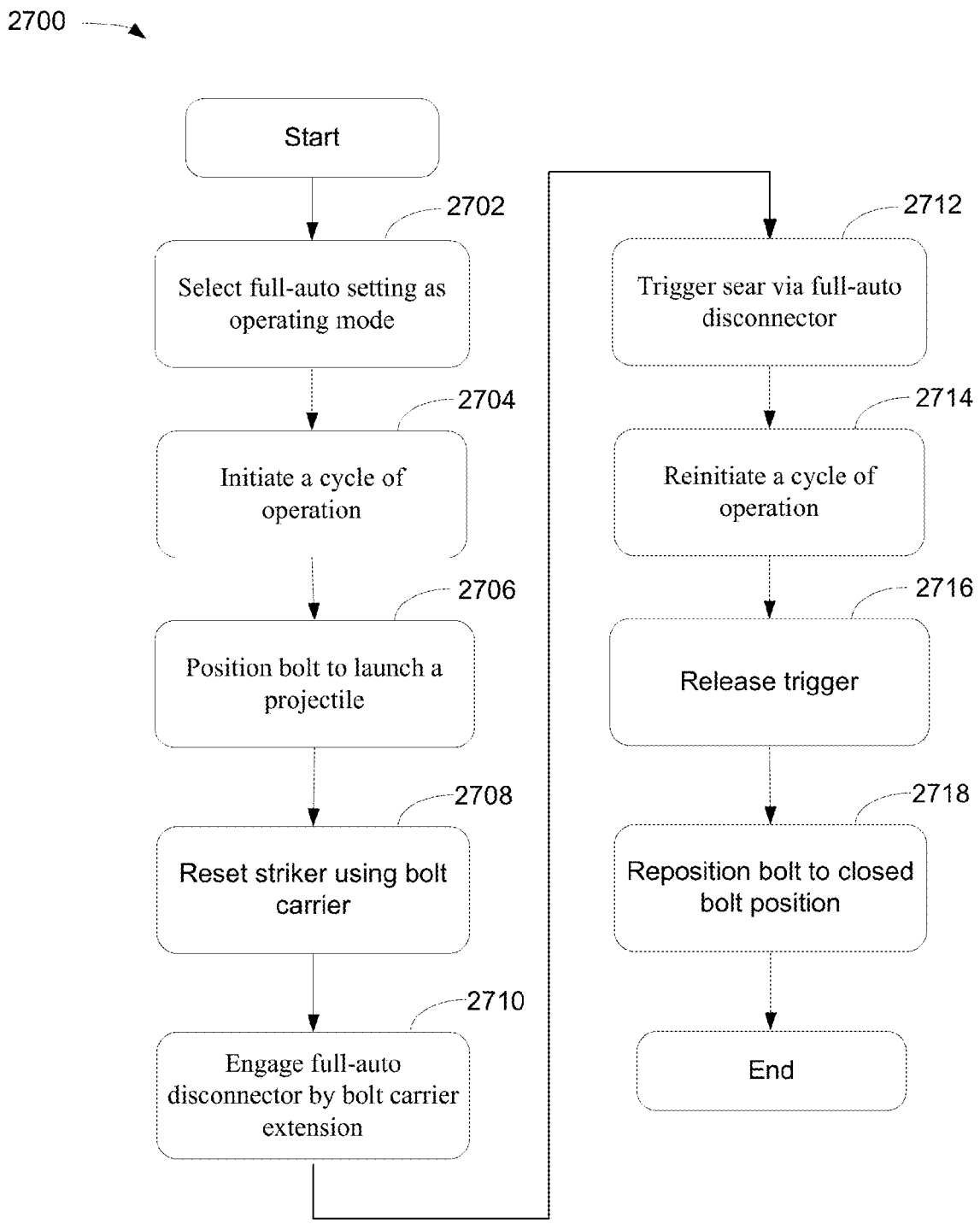
FIG. 27 is a flowchart illustrating a process of automatic firing using a bolt carrier extension and an auto-op lever in accordance with one embodiment of the present invention.

FIG. 27 is a flowchart 2700 illustrating a process of automatic firing using a bolt carrier extension and an auto-op lever in accordance with one embodiment of the present invention. After selecting a full-auto as an operating mode by pivotally rotating the operation selector at block 2702, a cycle of operation, at block 2704 is initiated by squeezing the trigger which releases a striker. When the striker engages with a valve pin, a stream of pressurized gas is gated by the valve to propel an object such as a paintball from a firing chamber to a target.

At block 2706, blowback force created by the launching a projectile such as paintball pushes bolt together with bolt carrier to a direction opposite from a travel direction of the paintball. As the bolt moves toward backside of launcher due to blowback force, bolt carrier extension, at block 2708, catches the striker and moves striker back to its resetting or cocking position. At block 2710, once the striker is cocked, bolt reset spring repositions the bolt to a predefined position such as a closed bolt position. Upon reaching to the predefined position, the bolt carrier extension engages or triggers a full-auto disconnector. At block 2712, the full-auto disconnector is situated or configured in such a way that one end of disconnector is in a path of incoming bolt carrier extension and another end of disconnector is situated in proximity or vicinity of the sear. At block 2714, when one end of the disconnector is engaged by the bolt carrier extension, the other end causes the sear to tilt away from the striker whereby striker 1316 is released. As such, the sear capable of being triggered by the bolt carrier extension reinitiates the cycle of operation until trigger 1318 is released. At block 2716, when the trigger is released, the full-auto disconnector disengages from the sear whereby the trigger is allowed to take over the control of sear. The bolt, at block 2718, is repositioned at a predefined position such as a closed bolt position to prepare for the next launch.

While particular embodiments of the present invention have been shown and described, it will be obvious to those of ordinary skills in the art that based upon the teachings herein, changes and modifications may be made without departing from this exemplary embodiment(s) of the present invention and its broader aspects. Therefore, the appended claims are intended to encompass within their scope all such changes and modifications as are within the true spirit and scope of this exemplary embodiment(s) of the present invention.

What is claimed is:

1. A projectile launching device comprising:

a bolt having an air channel for launching a projectile and a hammer groove, and configured to be able to move within a bolt chamber;

a valve coupled to the air channel of the bolt and having a valve pin configured to have a physical shape substantially like a single piece metal rod with a first end situated at approximately one end of the rod and a second end situated approximately at opposite end of the first end, the first end able to control amount of pressurized gas flowing into the air channel, and configured to be situated in a firing control chamber which is arranged in parallel to the bolt chamber;

a hammer having a pivot hole for hosting a pivot pin and configured to create a swing motion of the hammer around the pivot hole and to allow at least a portion of the hammer to pass through the hammer groove of the bolt during the swing motion before the hammer strikes the second end to release a predefined amount of pressurized gas to launch a paintball; and an auto-op lever having a first end and a second end, wherein the first end of the auto-op lever is triggerable by repositioning movement of the bolt and the second end of the auto-op lever is capable of releasing the hammer in response to movement of the first end of auto-op lever when a full-auto firing mode is selected.

2. The device of claim 1, further comprising a trigger coupled to the hammer and able to activate the hammer for firing.

3. The device of claim 2, wherein the bolt includes a hammer reset element able to reset the hammer to a ready to fire position during a launch process.

4. The device of claim 1, wherein the hammer is situated in the firing control chamber.

5. The device of claim 4, wherein the hammer groove permits a portion of hammer to temporarily pass through the hammer groove during the swing motion created by the hammer; wherein the swing motion guides the hammer to swing more than 90 degree before it hit the valve pin.

6. The device of claim 5, wherein the hammer is made of metal material able to open the valve when the hammer moves in a curved swing motion hitting a valve pin of the valve.

7. The device of claim 6, wherein the hammer has a substantially rectangular shape with one end couples to a pivotal pin facilitating the swinging motion and other end for contacting the valve.

8. The device of claim 6, wherein the hammer has an irregular elongated shape with one end couples to a pivotal pin capable of facilitating the swinging motion and other end for contacting the valve.

9. The device of claim 1, further comprising:

a pressurized gas tank coupled to the valve and configured to release a stream of pressurized gas for launching a paintball in response to the hammer;

a triggering mechanism coupled to the hammer and configured to control motion of the hammer for paintball launching.

10. A method of launching a paintball comprising:

releasing a hammer from a ready to fire position;

allowing the hammer to swing around a pivot pin passing through one end of the hammer;

facilitating a striking portion of the hammer to swing into a bolt chamber and a hammer groove of a bolt in response to an elastic element;

hitting a first end of a valve pin of a valve with the striking portion of the hammer and shifting a second end of the valve pin which is opposite end of the first end of a valve pin which is structured approximately as a longitudinal single piece bar in a predefined distance permitting pressurized gas to flow into a middle portion of a bolt;

releasing a predefined amount of pressurized gas before the striking portion of the hammer retracts from the valve pin; and launching a paintball via the portion of pressurized gas channeled through a bolt;

providing an auto-op lever having a first end and a second end;

triggering the first end of the auto-op lever by repositioning movement of the bolt; and releasing the hammer from the second end of the auto-op lever in response to movement of the first end of the auto-op lever when a full-auto firing mode is selected.

11. The method of claim 10, further comprising resetting the hammer to the ready for firing position via movement of the bolt during a launching process.

12. The method of claim 10, further comprising repositioning the bolt to a predefined position for next launch via the swing motion of the hammer.

13. The method of claim 10, further comprising repositioning the bolt to a closed position adjacent to a paintball before launching the paintball.

14. A paintball launcher comprising:

a bolt having an air channel for launching a paintball, wherein the bolt includes a hammer groove;

a valve coupled to the air channel of the bolt and having a valve pin configured to have a physical shape substantially like a single piece metal rod with a first end situated at approximately one end of the rod and a second end situated approximately at opposite end of the first end, the first end able to control flow of pressurized gas between the air channel and a pressurized gas canister, and configured to be situated in a firing control chamber which is arranged in parallel to the bolt chamber;

a hammer having a pivot hole for hosting a pivot pin and configured to create a swing motion of the hammer around the pivot hole and allowing at least a portion of the hammer to pass through the hammer groove during the swing motion before the hammer strikes the second end to release a predefined amount of pressurized gas to launch a paintball;

an auto-op lever having a first end and a second end, wherein the first end of the auto-op lever is triggerable by repositioning movement of the bolt and the second end of the auto-op lever is capable of releasing the hammer in response to movement of the first end of auto-op lever when a full-auto firing mode is selected; and an operation switch coupled to the hammer and configured to allow an operator to select from one of a single firing mode and a full-auto firing mode for paintball launching.

15. The device of claim 14, further comprising a trigger coupled to the hammer and able to activate the hammer for firing.

16. The device of claim 15, wherein the bolt includes a hammer reset element able to reset the hammer to a ready to fire position during a launch process.

17. The device of claim 14, wherein the hammer is situated in the firing control chamber.

18. The device of claim 17, wherein the bolt chamber is configured to have a hammer groove permitting a portion of hammer to temporarily pass through the hammer groove during the swing motion created by the hammer.

19. The device of claim 18, wherein the hammer is made of metal material having a predefined weight able to push the valve pin for a predefined distance when the hammer moves in a curved swing motion and hits the valve pin of the valve.

* * * * *